US011179590B1

(12) United States Patent
Nicholas

(10) Patent No.: US 11,179,590 B1
(45) Date of Patent: Nov. 23, 2021

(54) CONSTANT RESISTANCE GENERATING EXERCISE MACHINE

(71) Applicant: Paul James Nicholas, New York, NY (US)

(72) Inventor: Paul James Nicholas, New York, NY (US)

( * ) Notice: Subject to any disclaimer, the term of this patent is extended or adjusted under 35 U.S.C. 154(b) by 92 days.

(21) Appl. No.: 16/667,856

(22) Filed: Oct. 29, 2019

Related U.S. Application Data

(60) Provisional application No. 62/752,415, filed on Oct. 30, 2018.

(51) Int. Cl.

| | |
|---|---|
| ***A63B 21/04*** | (2006.01) |
| ***A63B 21/00*** | (2006.01) |
| ***A63B 21/22*** | (2006.01) |
| ***A63B 21/005*** | (2006.01) |

(52) U.S. Cl.
CPC ..... *A63B 21/0435* (2013.01); *A63B 21/0051* (2013.01); *A63B 21/153* (2013.01); *A63B 21/157* (2013.01); *A63B 21/225* (2013.01); *A63B 21/4001* (2015.10); *A63B 21/00047* (2013.01)

(58) Field of Classification Search
CPC ..... A63B 21/0051; A63B 21/0435; A63B 21/157; A63B 21/153; A63B 21/225; A63B 21/4001; A63B 21/00047; A63B 21/005; A63B 21/0052; A63B 21/0057; A63B 21/0058
See application file for complete search history.

(56) References Cited

U.S. PATENT DOCUMENTS

| | | | | |
|---|---|---|---|---|
| 4,469,324 | A | 9/1984 | Dolan | |
| 5,070,816 | A | 12/1991 | Wehrell | |
| 5,540,642 | A | 7/1996 | Sprague | |
| 5,711,404 | A * | 1/1998 | Lee | A63B 21/0051 188/158 |
| 5,916,069 | A | 6/1999 | Wang et al. | |
| 6,685,602 | B2 | 2/2004 | Colosky, Jr. et al. | |
| 9,833,662 | B2 * | 12/2017 | Potter | A63B 21/153 |

(Continued)

FOREIGN PATENT DOCUMENTS

| | | |
|---|---|---|
| WO | WO2008153979 | 12/2008 |
| WO | WO2015088670 | 6/2015 |

*Primary Examiner* — Megan Anderson
(74) *Attorney, Agent, or Firm* — Allen D. Hertz, P.A.; Allen D. Hertz

(57) ABSTRACT

A constant resistance exercise machine for sprint training or adaptation into exercise equipment having cyclical movements, preferably over a distance. The constant resistance exercise machine includes an exercise cable storage and feed reel, a constant tension spring motor, a resistance generating assembly, a flywheel, and an exercise cable. The constant tension spring motor is in operational communication with the exercise cable reel. The flywheel obtains a rotational resistance from the resistance generating assembly. The flywheel is in unidirectional rotational communication with the exercise cable reel via a one-way clutch bearing. The exercise cable is coiled about the exercise cable reel. The exercise cable is of a length that enables complete extraction of the cable from the exercise cable storage and feed reel and wherein the constant tension spring motor is arranged to retract a partially or completely extracted cable back onto the exercise cable reel.

20 Claims, 15 Drawing Sheets

(56) References Cited

U.S. PATENT DOCUMENTS

| | | | | |
|---|---|---|---|---|
| 10,143,880 | B1 * | 12/2018 | Boatwright ..... | A63B 21/078 |
| 2004/0116253 | A1 | 6/2004 | Radow | |
| 2004/0242388 | A1 | 12/2004 | Kusminsky | |
| 2005/0032613 | A1 | 2/2005 | Wehrell | |
| 2005/0181915 | A1 | 8/2005 | Hoecht et al. | |
| 2009/0156362 | A1 | 6/2009 | Berg | |
| 2011/0218076 | A1 | 9/2011 | Lawrence | |
| 2016/0325131 | A1 | 11/2016 | Wehrell | |
| 2017/0050069 | A1 | 2/2017 | Ky | |
| 2017/0197104 | A1 | 7/2017 | Turner | |
| 2017/0361145 | A1 | 12/2017 | Olson | |

* cited by examiner

CONSTANT RESISTANCE GENERATING EXERCISE MACHINE

CROSS REFERENCE TO RELATED APPLICATIONS

This application is a Non-Provisional Utility Application claiming the benefit of U.S. Provisional Patent Application Ser. No. 62/752,415, filed on Oct. 30, 2018, which is incorporated by reference herein in its entirety.

FIELD OF THE INVENTION

The present disclosure generally relates to exercise devices. More particularly, the present disclosure relates to an exercise resistance device that provides a constant resistance to a long exercise cable, enabling the exercise cable to be used to apply a resistance to an individual exercising in such as sprints, rowing, or any other exercise that would be supported by a sustained, constant resistance over an extended distance of travel.

BACKGROUND OF THE INVENTION

Over the years physical exercise has grown in popularity to improve the health and physical appearance of a person and also to reduce stress. There are a many forms of physical exercise that may be employed by a person such as: strength training, aerobics, calisthenics, and plyometrics to name a few. Several exercises require a resistance over a distance of travel. It is desirable that the resistance remains constant over the entire distance of travel.

A rowing exercise device utilizes a flywheel attached to a coil spring. The coil spring has a limited effective length, as one end is retained in a stationary location, where the second end is rotated about the coil, collecting the coils upon one another. This configuration increases the resistance of the coil spring during the retraction of the coil spring.

Adjustable resistance is applied to the flywheel by a distance adjusting magnetic resistance generating mechanism. The arrangement employs a magnet set and shear resistance from a magnetically conductive flywheel. The magnets are arranged tangentially to the magnetic flywheel. The closer the magnets are to a peripheral edge of the flywheel, the greater the magnetic resistance.

This configuration presents several limitations. A first limitation is the distance of travel of the exercise system. The distance is limited to the retractable length of the coil spring. Coil springs are limited to a short effective linear distance. A second limitation is that the magnet set in the shearing arrangement over the magnetic flywheel provides a limited adjustability of resistance. Since the magnetic resistance is located at the peripheral edge of the magnetic flywheel, a very small movement in a radial direction causes a significantly greater change in resistance compared to a system that is adjustable at a more radially inward location.

The resistance assembly is integrated into a rowing machine. The overall motion of the cable attached conveying the resistance from the operating mechanism of the rowing machine is approximately three (3) feet. The same mechanism would not be scalable to a device applied to an exercise machine for sprinting. A sprinting exercise is accomplished in a distance that is generally up to Twenty-five (25) feet, fifty (50) feet, one hundred (100) feet, one hundred fifty (150) feet, two hundred (200) feet, three hundred (300) feet, or even lengths that are greater than three hundred (300) feet. In one variant that has been reduced to practice, the distance is 100 feet. A goal of the design of this device is to support an exercise of a one hundred (100) meter cable.

Another exercise device is adapted to provide a resistance to an ambulatory (Walking, jogging, running, and the like) motion of a user. The operating mechanism of this exercise device employs a resistive strap which provides friction to a peripheral edge of the flywheel.

The ambulatory exercise machine establishes a generally consistent resistive force against a user who walks, steps, or runs away from the machine as part of a strength training exercise program. The machine is built upon a movable frame having transport wheel assemblies that allow the exercise machine to be place on a floor surface indoors or on the ground outdoors. The ambulatory exercise machine employs three (3) parallel spinning assemblies that together allow a linear strap attached to the user to run out from the ambulatory exercise machine and to thereafter be retracted or rewound back into the ambulatory exercise machine.

The spinning assemblies include a flywheel assembly, a spool assembly, and a spring assembly, each co-axially arranged on a spin axle extending across the frame. The spring assembly is fixed against the frame and incorporates a coil spring that tightens with the rotation of the spin axle in a first direction (allowing a linear run-out strap to extend from the spool assembly). The coil spring in the spring assembly thereafter tends to direct the rewinding of the linear run-out strap back onto the spool assembly when the extractive force exerted by the user is released.

The flywheel assembly is positioned opposite from the spring assembly across the spool assembly. The flywheel provides both an initial stationary inertia that the user must overcome in order to initiate rotation of the assemblies, and a rotating inertia once the system is in rotational motion. The flywheel acts as a governor to balance the changing forces associated with the spring assembly as the coil spring therein tightens and subsequently loosens. A spool assembly is located on the spin axle between the flywheel assembly and the spring assembly. The spool assembly allows the linear run-out strap to unwind and subsequently to be wound back again on the spool.

A guide strap is routed around the spool to help position and maintains the linear run-out strap within the spool assembly during both, retraction of the linear run-out strap and extension or dispensing of the linear run-out strap. A resistance adjustment assembly presses a brake pad against a perimeter surface of the flywheel to allow the user to adjust the force that is required to initiate rotation of the system.

The ambulatory exercise machine is one example of issues using the coil spring, more specifically, the coil spring generates changing forces as the coil spring therein tightens and subsequently loosens.

What is desired is an exercise machine that provides a constant resistance to a cable as the cable is extracted from the exercise machine. The exercise machine should be adaptable for any reasonable length of extracted and recoiled cord or cabling. The length of extracted cording can be upwards of 25, 30, 50, 75, 100 feet or more. The exercise machine would also include a capability of retracting the length of extracted cabling.

Efforts to provide an exercise machine that overcomes the drawbacks in the prior art have not met with significant success to date. As a result, there is a need in the art for an exercise machine that provides a constant resistance over an entire, extended distance of travel for distances of upwards of 25, 30, 50, 75, 100 feet or more. The same operating mechanism can then be adapted for use in machines that utilize shorter distances of travel.

SUMMARY OF THE INVENTION

The basic inventive concept provides a device that provides a constant resistance over an entire, extended distance of travel. The distance of travel can be upwards of 25, 30, 50, 75, 100 feet or more.

From an apparatus aspect, the invention comprises a constant resistance exercise machine for facilitating exercise training by providing a constant resistance over an entire, extended distance of travel. The constant resistance exercise machine includes an operational shaft that is in operational communication with an exercise cable storage and feed reel, a constant tension spring motor and a one-way clutch bearing assembly.

In one aspect, the constant resistance exercise machine comprises:

an exercise cable storage and feed reel;

a constant tension spring motor in operational communication with the exercise cable storage and feed reel;

a resistance generating assembly;

a flywheel obtaining rotational resistance from the resistance generating assembly, the flywheel in unidirectional rotational communication with the exercise cable storage and feed reel by way of a one-way clutch bearing; and an exercise cable coiled about the exercise cable storage and feed reel, wherein the exercise cable is of a length that enables complete extraction of the cable from the exercise cable storage and feed reel and wherein the constant tension spring motor is arranged to retract a completely extracted cable back onto the exercise cable storage and feed reel.

In a second aspect, the constant tension spring motor includes a constant tension spring motor output drum, a constant tension spring motor storage drum, and a constant tension spring motor spring. The constant tension spring motor spring is wound upon and extracted from the constant tension spring motor output drum and transferred to and collected upon the constant tension spring motor storage drum during a cable extraction process and the constant tension spring motor spring is returned to the constant tension spring motor output drum from the constant tension spring motor storage drum during a cable retraction process.

In another aspect, the constant tension spring motor spring is an elongate sheet of flat spring material having a first end and a second end and a pair of elongate edges extending between the first end and the second end.

In yet another aspect, the constant resistance exercise machine further comprises a constant resistance exercise machine frame.

In yet another aspect, the constant resistance exercise machine frame comprises a first outer support panel and a second outer support panel.

In yet another aspect, the constant resistance exercise machine frame can further comprise at least one central support panel, each at least one central support panel being located between the first outer support panel and the second outer support panel.

In yet another aspect, the first outer support panel and the second outer support panel are arranged being parallel to one another.

In yet another aspect, the first outer support panel and the second outer support panel can be supported by at least one base member and at least one top frame member.

In yet another aspect, wherein the at least one base member is a base panel.

In yet another aspect, the constant tension spring motor spring is an elongate sheet of flat spring material having a first end and a second end, the sheet having a natural curve along the elongated direction In yet another aspect, the constant resistance exercise machine further comprises a constant resistance exercise machine operating shaft.

In yet another aspect, the constant resistance exercise machine operating shaft is stationary respective to the constant resistance exercise machine frame.

In yet another aspect, the constant resistance exercise machine operating shaft is rotationally assembled to the constant resistance exercise machine frame.

In yet another aspect, the exercise cable storage and feed reel is concentric with and assembled to the constant resistance exercise machine operating shaft.

In yet another aspect, the exercise cable storage and feed reel is concentric with and rotationally assembled to the constant resistance exercise machine operating shaft.

In yet another aspect, the flywheel is concentric with and assembled about the constant resistance exercise machine operating shaft.

In yet another aspect, the flywheel is concentric with and assembled to the constant resistance exercise machine operating shaft.

In yet another aspect, the flywheel is concentric with and rotationally assembled to the constant resistance exercise machine operating shaft.

In yet another aspect, the constant tension spring motor collected spring portion is concentric with and assembled to the constant resistance exercise machine operating shaft.

In yet another aspect, at least one end of the constant tension spring motor spring includes at least one constant tension spring motor supply spring attachment flange.

In yet another aspect, at least one end of the constant tension spring motor spring includes at least one constant tension spring motor supply spring attachment flange extending substantially perpendicular to the constant tension spring motor spring.

In yet another aspect, at least one end of the constant tension spring motor spring includes a pair of constant tension spring motor supply spring attachment flanges.

In yet another aspect, at least one end of the constant tension spring motor spring includes a pair of constant tension spring motor supply spring attachment flanges, each constant tension spring motor supply spring attachment flange extending substantially perpendicular to the constant tension spring motor spring, the constant tension spring motor supply spring attachment flanges extending in opposite directions from one another.

In yet another aspect, at least one end of the constant tension spring motor spring includes at least one constant tension spring motor supply spring attachment assistance aperture, the constant tension spring motor supply spring attachment assistance aperture passing through the constant tension spring motor spring. The at least one constant tension spring motor supply spring attachment assistance aperture would be located proximate a respective end of the constant tension spring motor spring.

In yet another aspect, each at least one constant tension spring motor supply spring attachment assistance aperture is formed in a circular shape.

In yet another aspect, each at least one constant tension spring motor supply spring attachment assistance aperture is formed in a non-circular shape.

In yet another aspect, each at least one constant tension spring motor supply spring attachment assistance aperture is formed in an elliptical shape.

In yet another aspect, each at least one constant tension spring motor supply spring attachment assistance aperture is formed in a rectangular shape.

In yet another aspect, each at least one constant tension spring motor supply spring attachment assistance aperture is formed in a triangular shape.

In yet another aspect, each at least one constant tension spring motor supply spring attachment assistance aperture is formed in a polygonal shape.

In yet another aspect, each at least one constant tension spring motor supply spring attachment flange is formed in a rectangular shape.

In yet another aspect, each at least one constant tension spring motor supply spring attachment flange is formed in a rectangular shape, each flange corner being chamfered.

In yet another aspect, each at least one constant tension spring motor supply spring attachment flange is formed in a rectangular shape, each flange corner being rounded.

In yet another aspect, each at least one constant tension spring motor supply spring attachment flange is formed in a curved shape.

In yet another aspect, the constant tension spring motor output drum can include at least one constant tension spring motor supply spring attachment slot. The constant tension spring motor supply spring attachment slot is sized, shaped, and located to receive and retain a respective constant tension spring motor supply spring attachment flange.

In yet another aspect, the constant tension spring motor output drum can include a pair of constant tension spring motor supply spring attachment slots. Each constant tension spring motor supply spring attachment slot is sized, shaped, and located to receive and retain a respective constant tension spring motor supply spring attachment flange.

In yet another aspect, the one-way clutch bearing is concentric with and located about the constant resistance exercise machine operating shaft.

In yet another aspect, the one-way clutch bearing is concentric with and assembled to the constant resistance exercise machine operating shaft.

In yet another aspect, at least one shaft clamp is assembled to the constant resistance exercise machine operating shaft.

In yet another aspect, the at least one shaft clamp is assembled to the constant resistance exercise machine operating shaft at a location proximate the constant resistance exercise machine central support panel.

In yet another aspect, the at least one shaft clamp is assembled to the constant resistance exercise machine operating shaft at a location proximate the one-way clutch assembly.

In yet another aspect, the at least one shaft clamp is assembled to the constant resistance exercise machine operating shaft at a location proximate the exercise cable storage and feed reel.

In yet another aspect, the at least one shaft clamp is assembled to the constant resistance exercise machine operating shaft at a location proximate the constant tension spring motor storage drum.

In yet another aspect, the at least one shaft clamp is assembled to the constant resistance exercise machine operating shaft at a location proximate the flywheel.

In yet another aspect, the at least one shaft clamp is assembled to the constant resistance exercise machine operating shaft at a location proximate at least one of the outer support panels.

In yet another aspect, each of the at least one shaft clamp is affixed to the constant resistance exercise machine operating shaft, wherein each of the at least one shaft clamp rotates with the constant resistance exercise machine operating shaft.

In yet another aspect, the flywheel is concentric with and assembled about a variable resistance operating shaft.

In yet another aspect, the flywheel is concentric with and assembled to the variable resistance operating shaft.

In yet another aspect, the flywheel is concentric with and rotationally assembled to the variable resistance operating shaft.

In yet another aspect, the resistance generating assembly comprises a first magnetic disc located on a first side of the flywheel and a second magnetic disc located on a second side of the flywheel.

In yet another aspect, the resistance generating assembly comprises a first housing portion and a second housing portion mateably assembled to one another using any suitable mechanical fastener.

In yet another aspect, the first housing portion and the second housing portion are assembled to one another using a pin inserted into a bore.

In yet another aspect, the first housing portion and the second housing portion are assembled to one another using a pin inserted into a bore, wherein the pin and the bore are located proximate a circumferential edge of the first housing portion and the second housing portion.

In yet another aspect, the first housing portion includes a smooth surfaced bore passing therethrough and the second housing portion includes a threaded bore designed to receive a threaded fastener.

In yet another aspect, the first housing portion includes a smooth surfaced bore passing therethrough and the second housing portion includes a threaded bore designed to receive a threaded fastener, wherein the pin and the bore are located proximate a circumferential edge of the first housing portion and the second housing portion.

In yet another aspect, the first housing portion and the second housing portion are assembled to one another using a threaded fastener.

In yet another aspect, the smooth surfaced bore can include a first registration feature the threaded bore can include a second registration feature, wherein the first registration feature and the second registration feature are designed to engage with one another to aid in registration between the first housing portion and the second housing portion.

In yet another aspect, the flywheel is fabricated of a non-magnetic material.

In yet another aspect, the flywheel is fabricated of Aluminum.

In yet another aspect, perforations or large holes are formed through the flywheel.

In yet another aspect, the perforations or large holes formed through the flywheel are arranged at equally spaced intervals from one another.

In yet another aspect, notches are formed about a peripheral edge of the flywheel.

In yet another aspect, the notches are formed about a peripheral edge of the flywheel are arranged at equally spaced intervals from one another.

In yet another aspect, the notches are formed about a peripheral edge of the flywheel, wherein the notches and spaces are of equal lengths.

In yet another aspect, the resistance generating assembly comprises a pair of magnetically charged discs.

In yet another aspect, the resistance generating assembly comprises a pair of magnetically charged discs, wherein at least one magnetically charged disc of the pair of magnetically charged discs is provided as an annular ring circumscribing a support and angular indexing disc.

In yet another aspect, the resistance generating assembly comprises a pair of magnetically charged discs, wherein each of the magnetically charged discs of the pair of magnetically charged discs is provided as an annular ring circumscribing a support and angular indexing disc.

In yet another aspect, each magnetically charged annular ring is a diametrically magnetized ring magnet.

In yet another aspect, each magnetically charged annular ring is a diametrically magnetized ring magnet, where the magnetically charged annular ring is segmented into hemispheres, wherein each magnetically charged annular ring is magnetized where a first hemisphere of the magnetically charged annular ring has a North pole and a second hemisphere of the magnetically charged annular ring is referenced by a South pole.

In yet another aspect, each magnetically charged annular ring is a diametrically magnetized ring magnet, wherein each magnetically charged annular ring is magnetized where the magnetically charged annular ring is segmented into six equal segments, wherein opposite segments are referencing opposite magnetically oriented poles. More specifically, one segment has a North polarity and the opposite segment (180 degrees from the paired segment) has a South polarity. Each segment has an opposite polarity to the adjacent segment.

In yet another aspect, each magnetically charged annular ring is also magnetized through the thickness. In this reference, a first face of the magnetically charged annular ring has a first polarity reference (such as North) and a second, opposite face has a second, opposite polarity reference (such as South).

In yet another aspect, each magnetically charged annular ring is a diametrically magnetized ring magnet, wherein each magnetically charged annular ring is magnetized where the magnetically charged annular ring is segmented into six equal segments, wherein opposite segments are referencing opposite magnetically oriented poles. More specifically, one segment has a North polarity and the opposite segment (180 degrees from the paired segment) has a South polarity. Each segment has an opposite polarity to the adjacent segment, each segment also being magnetized through the thickness. Using the one segment as an example of the six segments, a first face of the magnetically charged annular ring has a first polarity reference (such as North) and a second, opposite face has a second, opposite polarity reference (such as South).

In yet another aspect, the flywheel has an outer diameter that is slightly greater than an outer diameter of the magnetically charged annular ring.

In yet another aspect, the flywheel has an outer diameter that is substantially equal to the outer diameter of the magnetically charged annular ring.

In yet another aspect, the flywheel has an outer diameter that is slightly less than the outer diameter of the magnetically charged annular ring.

In yet another aspect, notches are formed about a peripheral edge of the flywheel, each notch extending inward to a diameter that is slightly greater than an inner diameter of the magnetically charged annular ring.

In yet another aspect, notches are formed about a peripheral edge of the flywheel, each notch extending inward to a diameter that is substantially equal to the inner diameter of the magnetically charged annular ring.

In yet another aspect, notches are formed about a peripheral edge of the flywheel, each notch extending inward to a diameter that is slightly less than the inner diameter of the magnetically charged annular ring.

In yet another aspect, resistance is provided by a LENZ effect (according to Lenz's Law) created by the two magnetic discs, wherein the two magnetic discs are arranged concentric with one another, parallel to one another and wherein the flywheel is located between the first magnetic disc and second magnetic disc.

In yet another aspect, the first magnetically charged annular ring and the second magnetically charged annular ring are oriented having opposing faces rotated to align like magnetic polarities, wherein this configuration results in a low resistance. More specifically, a segment on the first magnetically charged annular ring having a South polarity is facing a like segment on the second magnetically charged annular ring having a like South polarity. Similarly, a segment on the first magnetically charged annular ring having a North polarity is facing a like segment on the second magnetically charged annular ring having a like North polarity.

In yet another aspect, the first magnetically charged annular ring and the second magnetically charged annular ring are oriented having opposing faces rotated to align opposite magnetic polarities, wherein this configuration results in a high resistance. More specifically, a segment on the first magnetically charged annular ring having a South polarity is facing a like segment on the second magnetically charged annular ring having an opposite North polarity. Similarly, a different segment on the first magnetically charged annular ring having a North polarity is facing a like segment on the second magnetically charged annular ring having an opposite South polarity.

In yet another aspect, the degree of resistance varies and increases as a rotatable magnetically charged annular ring is rotated respective to a fixed magnetically charged annular ring. The resistance increases as the rotatable magnetically charged annular ring is rotated from an orientation of low resistance where opposing segments of opposing discs have like polarities to an orientation of high resistance where opposing segments of opposing discs have opposite polarities. The resistance varies based on the percentage of overlap of like polarities compared to the percentage of opposite polarities. The greater the overlap of like polarities, the lower the resistance. The greater the overlap of opposite polarities, the higher the resistance.

In yet another aspect, the notches on the peripheral edge of the flywheel are arranged to be in alignment with the magnetically charged annular rings.

In yet another aspect, the magnetically charged annular rings can be replaced by a series of magnets arranged locating similar polarities accordingly.

In yet another aspect, the resistance generating assembly comprises an adjustment feature integrated into one of the first housing portion and the second housing portion, wherein the adjustment feature enables rotation of one of the two magnetic discs.

In yet another aspect, the resistance generating assembly comprises at least one magnetic disc spacing adjustment mechanism, wherein the at least one magnetic disc spacing adjustment mechanism adjusts spacing between the first magnetic disc and the second magnetic disc.

In yet another aspect, the magnetic disc spacing adjustment mechanism employs a spacing adjustment mechanism cam surface, wherein the spacing adjustment mechanism cam surface engages with a spacing adjustment disc cam engaging flange formed on the magnetic disc. The spacing adjustment mechanism cam surface is angled respective to the spacing adjustment disc cam engaging flange. The spacing adjustment disc cam engaging flange is located adjacent to a clearance. The clearance allows the larger portion of the spacing adjustment mechanism cam surface to be positioned within the clearance, while the contacting surface of the spacing adjustment mechanism cam surface defines the spacing between the pair of magnetic discs. As the adjustable magnetic resistance unit resistance spacing adjustment mechanism is rotated about a rotational axis of the pair of discs and the flywheel, the spacing adjustment mechanism cam surface translates the rotational motion into an axial force, adjusting the spacing between the pair of magnetic discs.

In yet another aspect, the magnetic disc spacing adjustment mechanism including the spacing adjustment mechanism cam surface, can be integrated into a portion of an adjustable magnetic resistance unit housing section.

In yet another aspect, the magnetic disc spacing adjustment mechanism including the spacing adjustment mechanism cam surface, can be rotationally assembled to the portion of the adjustable magnetic resistance unit housing section.

In yet another aspect, a pulley drive system can be utilized to transfer resistance force from the flywheel and associated resistance generating assembly to the one-way clutch bearing.

In yet another aspect, one-way clutch bearing pulley is concentrically assembled to the one-way clutch bearing.

In yet another aspect, an adjustable magnetic resistance unit drive pulley is concentrically assembled to the flywheel and associated resistance generating assembly.

In yet another aspect, one-way clutch bearing pulley is concentrically assembled to the one-way clutch bearing.

In yet another aspect, a ratio between a diameter of the one-way clutch bearing pulley and a diameter of the adjustable magnetic resistance unit drive pulley can be utilized to change a torque and/or rotational speed between the flywheel and one of the constant resistance exercise machine operating shaft and the exercise cable storage and feed reel.

In yet another aspect, a geared drive system can be utilized to transfer resistance force from the flywheel and associated resistance generating assembly to the one-way clutch bearing.

In yet another aspect, the flywheel and associated resistance generating assembly can be directly coupled to the one-way clutch bearing.

In yet another aspect, the flywheel and associated resistance generating assembly can be directly coupled to the one-way clutch bearing, wherein the flywheel and associated resistance generating assembly and the one-way clutch bearing are concentrically arranged with one another.

In yet another aspect, the exercise cable can be of a cording, a cabling, and the like.

In yet another aspect, a quick connect element can be secured to a free end of the exercise cable.

In yet another aspect, the quick connect element can be a carabiner.

In yet another aspect, a harness can be secured to a user of the constant resistance exercise machine.

In yet another aspect, the harness can be secured to a waist of the user of the constant resistance exercise machine.

In yet another aspect, the harness can be secured to a torso of the user of the constant resistance exercise machine.

In yet another aspect, the harness can be secured to shoulders of the user of the constant resistance exercise machine.

In yet another aspect, the constant resistance exercise machine is integrated into a sprint training machine.

In yet another aspect, the constant resistance exercise machine is integrated into a rowing machine.

From a system aspect, the invention comprises a constant tension spring motor, which in combination with a magnetic resistance unit and a unidirectional clutch provides a constant resistance over an entire, extended distance of travel.

In one aspect, the present invention provides a method for exercising, the method comprising:

obtaining a constant resistance exercise machine comprising:

an exercise cable storage and feed reel, a constant tension spring motor in operational communication with the exercise cable storage and feed reel, a resistance generating assembly, a flywheel obtaining rotational resistance from the resistance generating assembly, the flywheel in unidirectional rotational communication with the exercise cable storage and feed reel by way of a one-way clutch bearing, and an exercise cable coiled about the exercise cable storage and feed reel, wherein the exercise cable is of a length that enables complete extraction of the cable from the exercise cable storage and feed reel and wherein the constant tension spring motor is arranged to retract a completely extracted cable back onto the exercise cable storage and feed reel;

securing a free end of the exercise cable to an element that draws the exercise cable from the exercise cable storage and feed reel;

moving the element in a direction to draw the exercise cable from the exercise cable storage and feed reel;

providing a constant resistance to the exercise cable, wherein the constant resistance is provided by the resistance generating assembly applying a resistance to the flywheel and by a constant resistance provided by the constant tension spring motor;

retracting the exercise cable and collecting the exercise cable onto the exercise cable storage and feed reel by removing any tension applied to the free end of the exercise cable, wherein a retraction force is generated by the constant tension spring motor.

In a second aspect, the flywheel is isolated from the machine during the exercise cable retraction process by the one-way clutch bearing.

In another aspect, the free end of the exercise cable is secured to an individual for an ambulatory exercise by securing the free end of the exercise cable to a harness.

In yet another aspect, the harness is secured to a waist of an exercising user.

In yet another aspect, the harness is secured to a torso of the exercising user.

In yet another aspect, the harness is secured to shoulders of the exercising user.

In yet another aspect, the free end of the exercise cable is secured to the harness using a quick connect element.

In yet another aspect, the quick connect element is a carabiner.

In yet another aspect, the constant resistance exercise machine is integrated into a rowing machine, wherein the user exercises by using the rowing machine. The rowing machine includes at least one of an arm movement resistance feature and a foot or torso movement resistance feature. The at least one of an arm movement resistance feature and a foot or torso movement resistance feature is coupled to the constant resistance exercise machine. The user would sit on a seat that is either stationary or slidably assembled to an elongated track, grip the arm movement resistance feature with their hand, and place their feet against a foot rest, wherein the foot rest is either stationary or moveably assembled to a rowing machine frame.

In yet another aspect, the constant tension spring motor includes a constant tension spring motor output drum, a constant tension spring motor storage drum, and a constant tension spring motor spring, wherein in use the constant tension spring motor spring is wound upon and extracted from the constant tension spring motor output drum and transferred to and collected upon the constant tension spring motor storage drum during a cable extraction process and the constant tension spring motor spring is returned to the constant tension spring motor output drum from the constant tension spring motor storage drum during a cable retraction process.

In yet another aspect, the resistance generating assembly includes a first magnetic disc located on a first side of the flywheel and a second magnetic disc located on a second side of the flywheel. Spacing between the first magnetic disc and the second magnetic disc is adjustable by a resistance adjusting feature. The method comprises a step of adjusting a spacing between a pair of parallel arranged magnetic discs encasing a non-magnetic metallic flywheel to adjust a resistance to rotational motion of the flywheel.

In yet another aspect, the spacing between a pair of parallel arranged magnetic discs encasing the non-magnetic flywheel utilizes a Lenz effect. The Lenz effect creates an eddy within an electrical field and subsequently, a magnetic field. The movement of a magnetic material across a non-magnetic metallic material, such as Aluminum, copper, and the like, causes an electrical current to flow in the metallic material. The rotation of the non-magnetic, metallic flywheel between the two stationary magnetic discs affects the magnetic field, this creating a resistance to a rotation of the non-magnetic metallic flywheel. One method of understanding a Lenz effect is to drop a magnetic ball through an aluminum pipe. The magnetic ball will slow as it passes through the bore of the pipe, wherein the resistance is provided by the Lenz effect.

In yet another aspect, the method includes a step of controlling axial motion of one or more elements by introducing shaft clamps onto the constant resistance exercise machine operating shaft at a location proximate or preferably abutting the respective element.

In yet another aspect, the method includes a step of adjusting a ratio of rotation between the flywheel and the one-way clutch bearing by introducing a pair of pulleys and a belt.

In yet another aspect, the method includes a step of adjusting a ratio of rotation between the flywheel and the one-way clutch bearing by introducing a gearing assembly.

In yet another aspect, the method includes a step of transferring a resistance to the exercise cable by employing a constant resistance exercise machine operating shaft.

In yet another aspect, the method includes a step of rotating the constant resistance exercise machine operating shaft to transfer a resistance force from the resistance generating assembly and the flywheel to the shaft, then transferring the resistance to the exercise cable storage and feed reel, which transfers the resistance to the exercise cable.

In yet another aspect, the method includes a step of rotating the constant resistance exercise machine operating shaft to transfer a resistance force from the constant tension spring motor to the shaft, then transferring the resistance to the exercise cable storage and feed reel, which transfers the resistance to the exercise cable.

In yet another aspect, the method includes a step of rotating the constant resistance exercise machine operating shaft to transfer a resistance force from the constant tension spring motor to the shaft, then transferring the resistance to the exercise cable storage and feed reel, which transfers the resistance to the exercise cable.

In yet another aspect, the method includes a step of retracting the exercise cable onto the exercise cable storage and feed reel by rotating the constant resistance exercise machine operating shaft in an opposite direction to transfer a collection force from the constant tension spring motor to the shaft, then transferring the collection force to the exercise cable storage and feed reel, which transfers the collection force to draw the exercise cable onto the exercise cable storage and feed reel.

For a fuller understanding of the nature and advantages of the present invention, reference should be made to the ensuing detailed description of the preferred embodiments taken in conjunction with the accompanying drawings.

BRIEF DESCRIPTION OF THE DRAWINGS

The components in the figures are not necessarily to scale, emphasis instead being placed upon illustrating the principles of the invention. The invention will now be described, by way of example, with reference to the accompanying drawings, in which.

In the figures, like reference numerals designate corresponding elements throughout the different views of the drawings.

DETAILED DESCRIPTION OF THE PREFERRED EMBODIMENTS

Figure 1:
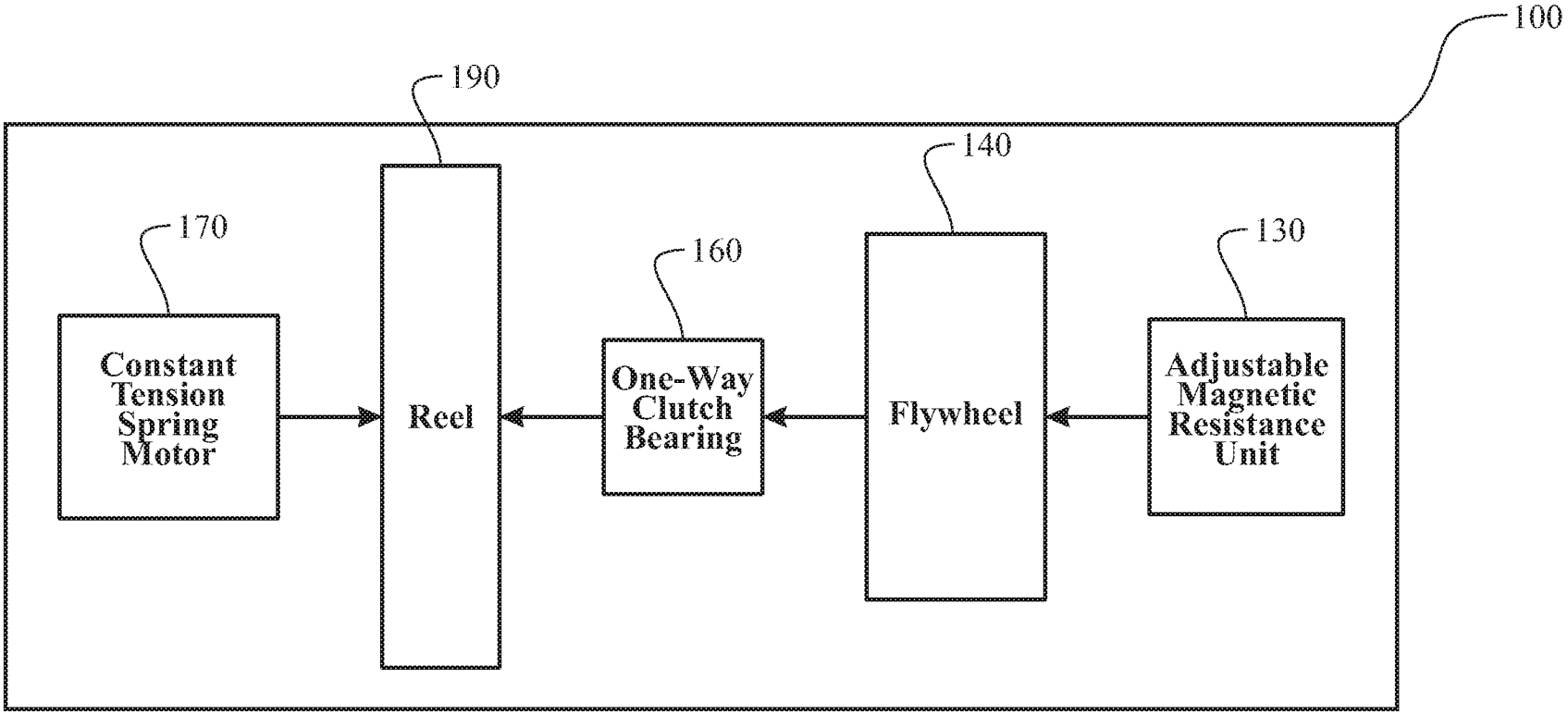
FIG. 1 presents a schematic diagram of an exemplary constant resistance exercise machine in accordance with the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments that may be disclosed herein are not to be considered as limiting, unless the claims expressly state otherwise.

Figure 2:
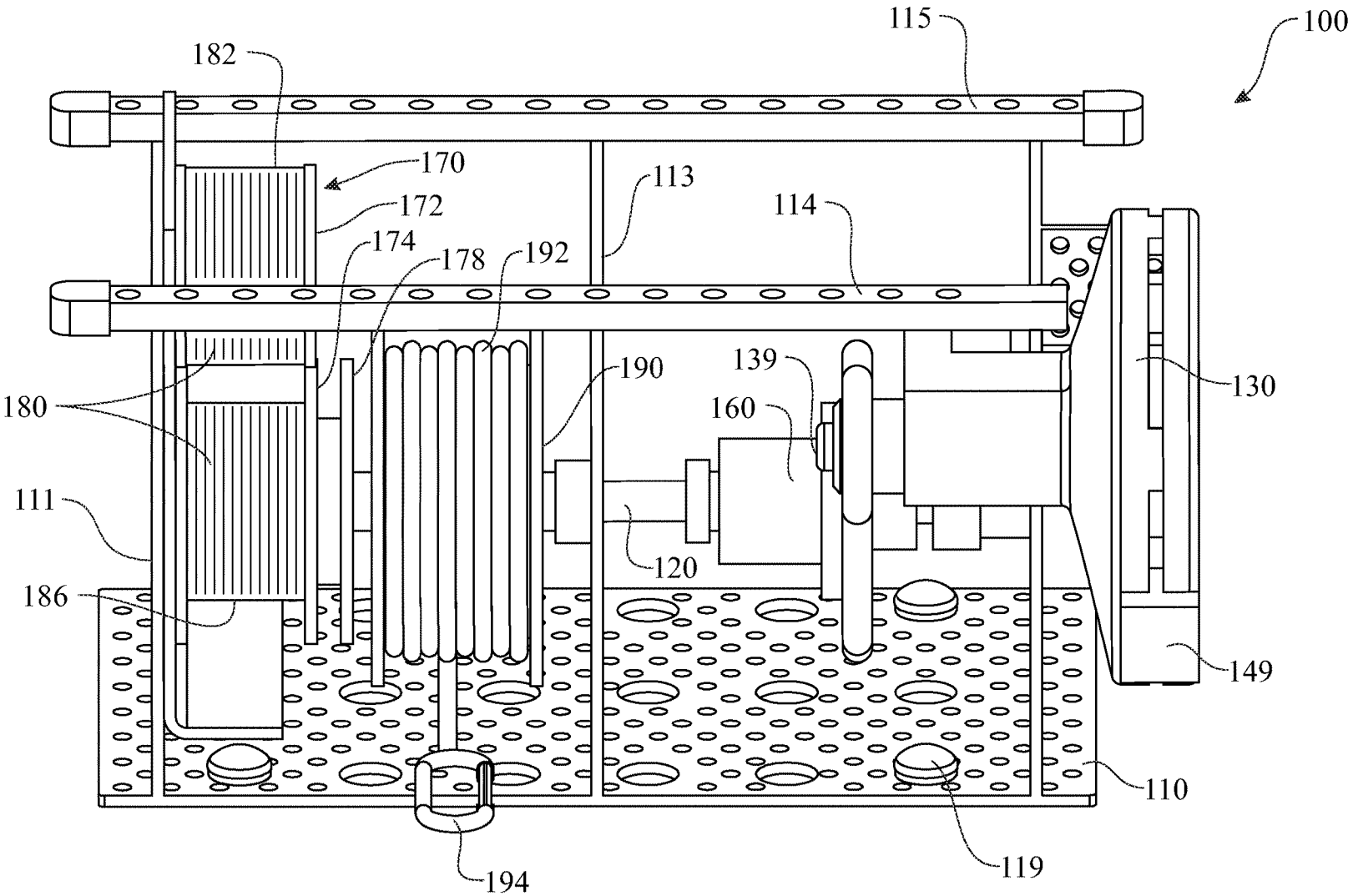
FIG. 2 presents a front, top elevation perspective view of an exemplary constant resistance exercise machine in accordance with the schematic diagram originally introduced in FIG. 1.
Figure 3:
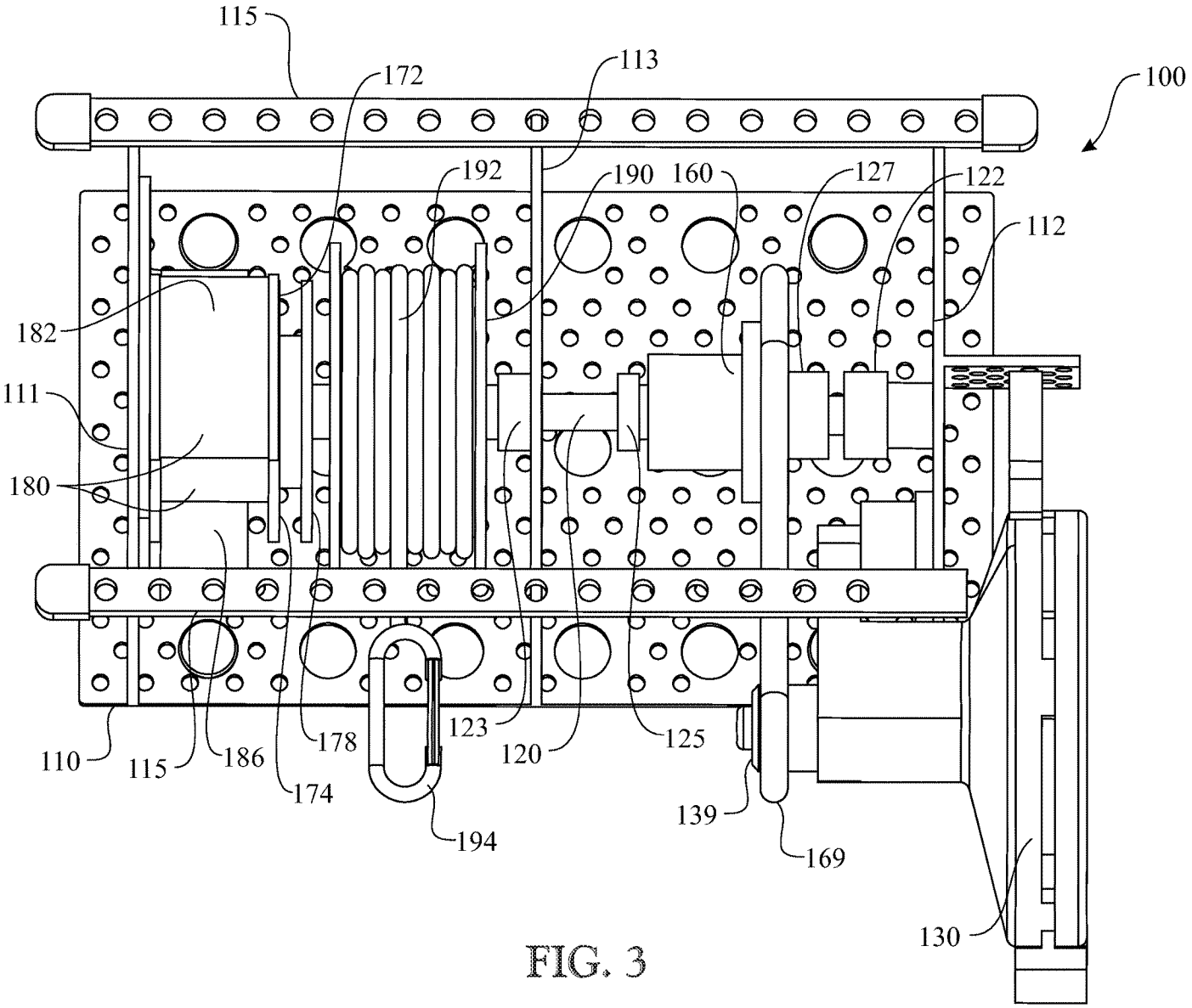
FIG. 3 presents a top plan perspective view of the exemplary constant resistance exercise machine originally introduced in FIG. 1.
Figure 4:
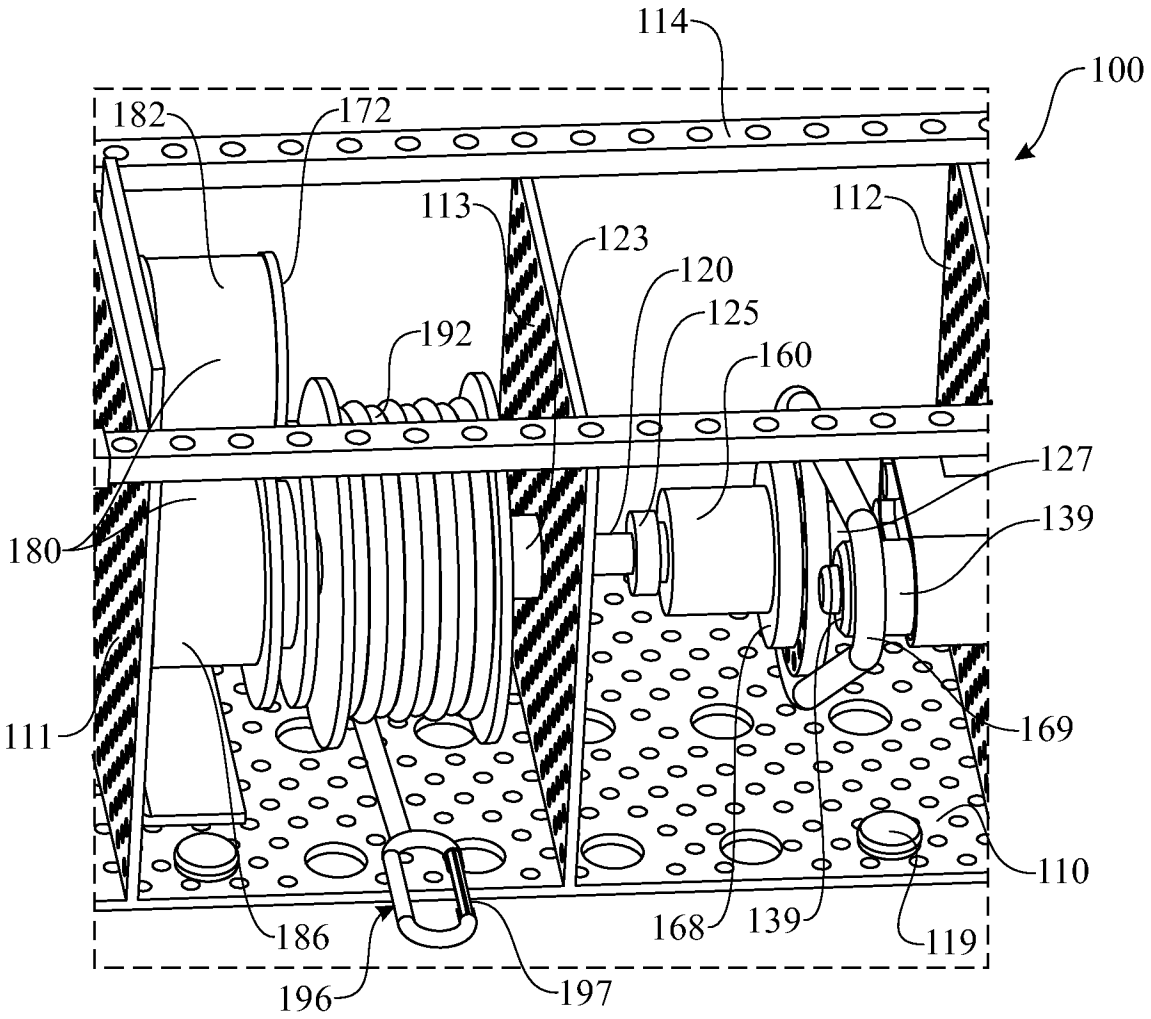
FIG. 4 presents an enlarged front, top elevation perspective view of the exemplary constant resistance exercise machine originally introduced in FIG. 1.

The present invention is described as a constant resistance exercise machine 100, illustrated in FIGS. 1 through 4 and 6 through 15. The constant resistance exercise machine 100 is illustrated in use in FIG. 5. The constant resistance exercise machine 100 includes four (4) primary components, as shown in an exemplary schematic diagram illustrated in FIG. 1. The constant resistance exercise machine 100 includes an exercise cable storage and feed reel 190 secured to a shaft 120 (FIG. 2). The exercise cable storage and feed reel 190 is in operational communication with a constant tension spring motor 170. The exercise cable storage and feed reel 190 is also in operational communication with an adjustable magnetic resistance unit non-magnetic flywheel 140 by way of a one-way clutch assembly 160. An adjustable magnetic resistance unit 130 provides adjustable rotational resistance to the adjustable magnetic resistance unit non-magnetic flywheel 140. Details of the constant resistance exercise machine 100 are presented in FIGS. 2 through 4 and 6 through 15.

The constant resistance exercise machine 100 is supported by a support structure. The support structure can be provided in any suitable arrangement. In the exemplary illustration, the support structure is provided as a constant resistance exercise machine base member 110, supporting a series of panels 111, 112, 113 extending substantially perpendicular to the constant resistance exercise machine base member 110. The series of panels 111, 112, 113 are supported by a constant resistance exercise machine forward support beam 114 and a constant resistance exercise machine rear support beam 115.

The exercise cable storage and feed reel 190 includes a drum and a pair of flanges. Each flange is commonly arranged extending substantially radially from each respective end of the drum. A length of exercise cable 192 (FIG. 2) is rolled upon the drum of the exercise cable storage and feed reel 190, and retained thereon by the pair of flanges. The exercise cable storage and feed reel 190 is rotationally secured to the constant resistance exercise machine operating shaft 120. The exercise cable storage and feed reel 190 can be fixed to the constant resistance exercise machine operating shaft 120, where the constant resistance exercise machine operating shaft 120 is assembled to the support structure in a rotational arrangement, where the constant resistance exercise machine operating shaft 120 rotates respective to the support structure, as shown in the exemplary embodiment. When the constant resistance exercise machine operating shaft 120 is rotationally assembled to the support structure, the constant resistance exercise machine operating shaft 120 can be used to transfer torsional forces between the elements 130, 140, 160, 170, 190.

One or more shaft clamps 122, 123, 125, 127 can be secured to the constant resistance exercise machine operating shaft 120. The one or more shaft clamps 122, 123, 125, 127 can be located to retain one or more components in an axial position on the shaft, retain the shaft in an axial position on the support structure, and the like or any combination thereof. Roller bearings, bushings, and the like can also be used to rotationally support the constant resistance exercise machine operating shaft 120.

Alternatively, the exercise cable storage and feed reel 190 can be rotationally assembled to the constant resistance exercise machine operating shaft 120, where the constant resistance exercise machine operating shaft 120 is fixed respective to the support structure. In this configuration, the elements of the constant resistance exercise machine 100 would be assembled to one another in order to provide a transfer of torsional forces between the elements 130, 140, 160, 170, 190. For example, the exercise cable storage and feed reel 190 can be secured directly to at least one of the constant tension spring motor 170 and the one-way clutch assembly 160.

In one assembly arrangement, the exercise cable storage and feed reel 190 can be assembled directly to the constant tension spring motor 170. More specifically, one flange of the exercise cable storage and feed reel 190 can be assembled directly to a constant tension spring motor assembly flange 178 of a constant tension spring motor storage drum 174 of the constant tension spring motor 170. In another arrangement the exercise cable storage and feed reel 190 can be assembled directly to the one-way clutch assembly 160. Although the drawings are not illustrated representing the arrangement, it is understood that the exercise cable storage and feed reel 190 can be assembled directly to the one-way clutch assembly 160. For example, the one-way clutch assembly 160 can include a flange. The flange of the one-way clutch assembly 160 would be secured to the respective flange of the exercise cable storage and feed reel 190.

The one-way clutch assembly 160 can be assembly directly to an element of the adjustable magnetic resistance unit non-magnetic flywheel 140 or indirectly coupled to an element of the adjustable magnetic resistance unit non-magnetic flywheel 140 by any of a variety of arrangements. In the illustrated exemplary arrangement, the adjustable magnetic resistance unit non-magnetic flywheel 140 is coupled to an adjustable magnetic resistance unit drive pulley 139, which is in rotational engagement with the one-way clutch assembly 160 by a clutch drive element 169. The clutch drive element 169 is routed about the groove in the adjustable magnetic resistance unit drive pulley 139 and a groove in a pulley attached to an input side of the one-way clutch assembly 160. Tension can be applied to the clutch drive element 169 using any suitable tension adjusting configuration. The clutch drive element 169 can be a belt, an o-ring, a chain, or any other suitable arrangement. It is also understood that the one-way clutch assembly 160 and the adjustable magnetic resistance unit non-magnetic flywheel 140 can be operationally joined by a gear assembly.

In another exemplary arrangement, the adjustable magnetic resistance unit non-magnetic flywheel 140 can be coupled to the one-way clutch assembly 160 by way of an input shaft. In yet another exemplary arrangement, the adjustable magnetic resistance unit non-magnetic flywheel 140 can be coupled to an associated flywheel shaft, where the flywheel shaft is either an input shaft of the one-way clutch assembly 160 or coupled to the input shaft of the one-way clutch assembly 160. In a configuration where the flywheel shaft and the one-way clutch input shaft are two different components, the flywheel shaft would be in rotational alignment with the input shaft of the one-way clutch assembly 160.

Figure 5:
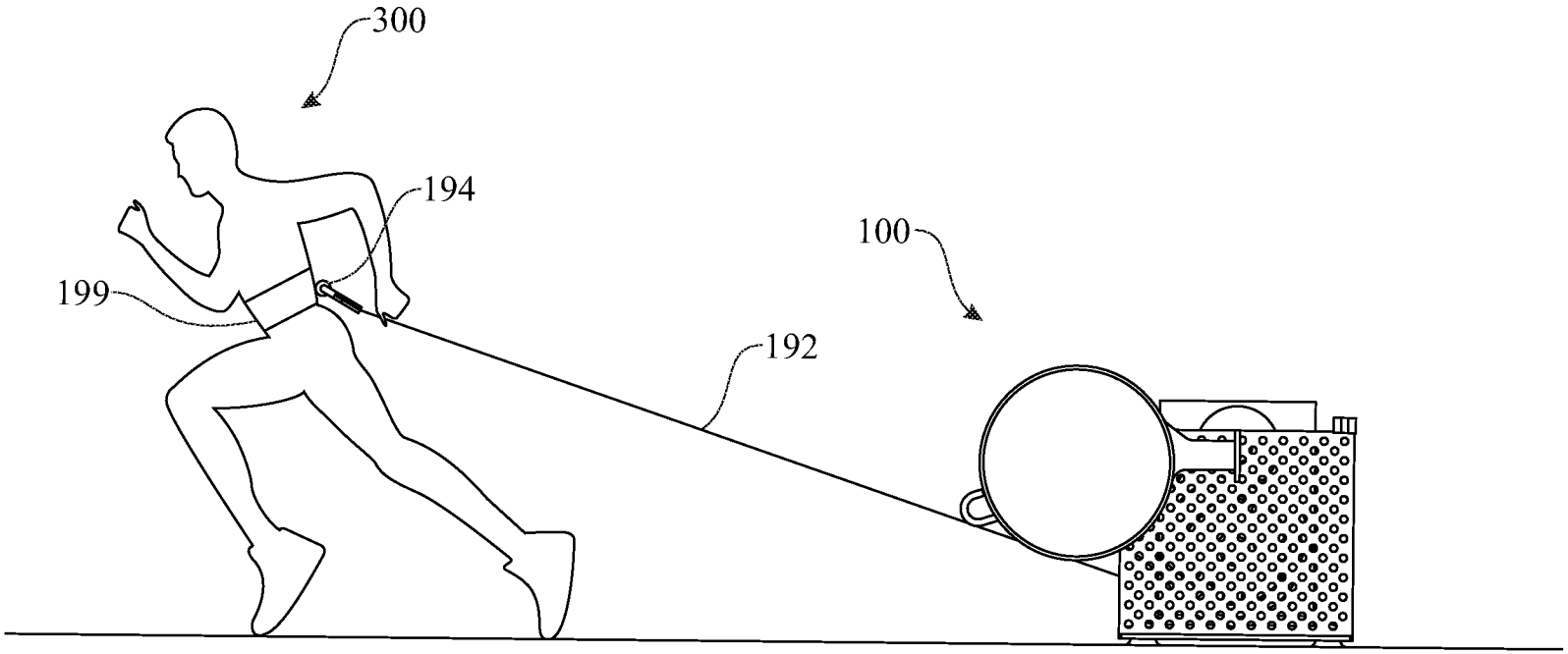
FIG. 5 presents a schematic view of the exemplary constant resistance exercise machine originally introduced in FIG. 1 in use as a sprint exercising machine.

The constant resistance exercise machine 100 is designed to provide a constant resistance to the exercise cable 192 when the exercise cable 192 is drawn from the exercise cable storage and feed reel 190. The constant resistance exercise machine 100 can be applied to any suitable exercise routine and/or exercise machine. One example is illustrated in FIG. 5, where the constant resistance exercise machine 100 is utilized to provide resistance during a sprinting exercise. An exercising party harness 199 is secured to an exercising party 300. The exercise cable 192 is temporarily coupled to the exercising party harness 199 by a quick connect element such as a carabiner 194. The constant resistance exercise machine 100 would preferably be retained in position by securing the frame or housing of the constant resistance exercise machine 100 to a stationary object, such as a wall, the ground, or any other suitable object. Alternatively, the exercise cable 192 can be permanently assembled to the exercising party harness 199. In the exemplary illustration, the constant resistance exercise machine 100 is being used to provide resistance to a sprinter during a sprinting exercise. The device can be used for other distance exercise routines, such as a skating exercise machine (such as one for hockey players), dance training, and the like. The constant resistance exercise machine 100 can be adapted for use when the direction of travel is horizontal, vertical, or any angle therebetween. For example, the constant resistance exercise machine 100 can be employed during resisted vertical jump training, rock or wall climbing, and the like. As previously stated, the constant resistance exercise machine 100 can be applied to any other suitable exercise routine and/or machine, including a rowing machine, an elliptical machine, a stationary bicycle, arm/shoulder exercise machines, any cable exercise or anaerobic exercise (such as rowing in a zero gravity environment), and the like. It is also recognized that the constant resistance exercise machine 100 can be employed to control motion of equipment, such as controlling motion of a camera or video equipment, or any other object that requires a constant/adjustable resistance/speed over a long distance.

The exercise cable 192 can be threaded through an aperture formed through a guide element. The guide element can be rotationally assembled to the support structure. This enables the user to rotate the guide element, thus defining a direction of disbursement of the exercise cable 192.

The exercising party harness 199 can be designed to be secured to the exercising party 300 around the waist, the shoulders, the torso, or any suitable location on the exercising party 300.

Returning to the structure and detailed operation of the constant resistance exercise machine 100, the exercise cable 192 can be a cording, a rope, a cabling, chain, monofilament, or any other flexible elongated component.

Cording can be considered as a metallic wire, a metallic wire encased within an insulator, a string made of multiple strands twisted together, and the like.

Ropes can be fabricated of common natural fibers, such as Manila hemp, hemp, linen, cotton, coir, jute, straw, and sisal. Synthetic fibers can be used for rope-making, whereby the synthetic fibers can include polypropylene, nylon, polyesters (for example: PET, LCP, Vectran), polyethylene (for example: Dyneema and Spectra), Aramids (for example: Twaron, Technora and Kevlar) and acrylics (for example: Dralon). Some ropes are constructed of mixtures of several fibers or use co-polymer fibers. Wire rope is made of steel or other metal alloys. Ropes have been constructed of other fibrous materials such as silk, wool, and hair, but such ropes are not generally available. Rayon is a regenerated fiber used to make decorative rope.

The twist of the strands in a twisted or braided rope serves not only to keep a rope together, but enables the rope to more evenly distribute tension among the individual strands. Without any twist in the rope, the shortest strand(s) would always be supporting a much higher proportion of the total load.

The rope can be laid rope or twisted rope, braided rope, plaited rope, endless winding rope, and the like.

The cable can be nautical cable, wire rope, arresting cable, Bowden cable, flexible shaft cable, and the like.

One end of the exercise cable 192 is preferably secured to the exercise cable storage and feed reel 190. The exercise cable 192 can be secured to the exercise cable storage and feed reel 190 in any suitable manner. For example, an attachment end of the exercise cable 192 can be secured to a drum of the exercise cable storage and feed reel 190. In another example, the attachment end of the exercise cable 192 can be secured to a flange of the exercise cable storage and feed reel 190. The quick connect element, such as the carabiner 194 or the exercising party harness 199 is secured to a free end of the exercise cable 192, as shown in FIG. 2. The carabiner 194 includes a carabiner spine and basket 196 formed in an incomplete loop and a carabiner gate 197 that moves to open and close an opening or passageway formed in the carabiner spine and basket 196. The carabiner 194 can be secured to the free end of the exercise cable 192 using a swivel or any other rotating mechanism to avoid twisting of the exercise cable 192.

The constant resistance exercise machine operating shaft 120 can be rotationally assembled to the support structure. The support structure can be provided in any suitable arrangement. The exemplary illustration includes a constant resistance exercise machine base member 110 that can be fabricated of any suitable planar sheet of material, a molded material, and the like. Feet 119 can be assembled to the constant resistance exercise machine base member 110 using any suitable assembly components and/or techniques. The constant resistance exercise machine pliant feet 119 are preferably fabricated of a resilient material, such as rubber, nylon, a soft plastic, and the like. The resiliency of the constant resistance exercise machine pliant foot 119 provides dampening to any motion generated during use of the constant resistance exercise machine 100. A mounting feature can be included in the constant resistance exercise machine pliant foot 119. The mounting feature provides an element for securing the constant resistance exercise machine 100 to an object, such as those previously described herein.

The exemplary illustration includes a constant resistance exercise machine first outer support panel 111 and a constant resistance exercise machine second outer support panel 112 that are assembled to an upper or internal surface of the constant resistance exercise machine base member 110. Each of the constant resistance exercise machine first outer support panel 111 and the constant resistance exercise machine second outer support panel 112 are oriented being substantially perpendicular to the constant resistance exercise machine base member 110. Each of the constant resistance exercise machine first outer support panel 111 and the constant resistance exercise machine second outer support panel 112 can be fabricated of any suitable planar sheet of material, a molded material, and the like. Each of the constant resistance exercise machine first outer support panel 111 and the constant resistance exercise machine second outer support panel 112 can include features for assembly of the constant resistance exercise machine operating shaft 120, the constant tension spring motor 170, the adjustable magnetic resistance unit 130, and any other element thereto.

The exemplary illustration includes a constant resistance exercise machine central support panel 113 that is also assembled to an upper or internal surface of the constant resistance exercise machine base member 110. The constant resistance exercise machine central support panel 113 would be located between the constant resistance exercise machine first outer support panel 111 and the constant resistance exercise machine second outer support panel 112. The constant resistance exercise machine central support panel 113 is oriented being substantially perpendicular to the constant resistance exercise machine base member 110. The constant resistance exercise machine central support panel 113 can be fabricated of any suitable planar sheet of material, a molded material, and the like. The constant resistance exercise machine central support panel 113 can include features providing clearance for and/or support to the constant resistance exercise machine operating shaft 120 or any other element thereto. In the exemplary illustration, a clearance aperture is provided through the constant resistance exercise machine central support panel 113, enabling passage of the constant resistance exercise machine operating shaft 120 therethrough. The primary function of the constant resistance exercise machine central support panel 113 is to centrally support the constant resistance exercise machine operating shaft 120 and provide an additional element to aid in retaining axial registration.

The support panels 111, 112, 113 can be supported at a distal or upper edge by any suitable support structure. In the exemplary illustrations, the support panels 111, 112, 113 are supported at the distal or upper edge by a constant resistance exercise machine forward support beam 114 and a constant resistance exercise machine rear support beam 115. In an alternative arrangement, a panel can be assembled to the distal or upper edges of the support panels 111, 112, 113.

Figure 6:
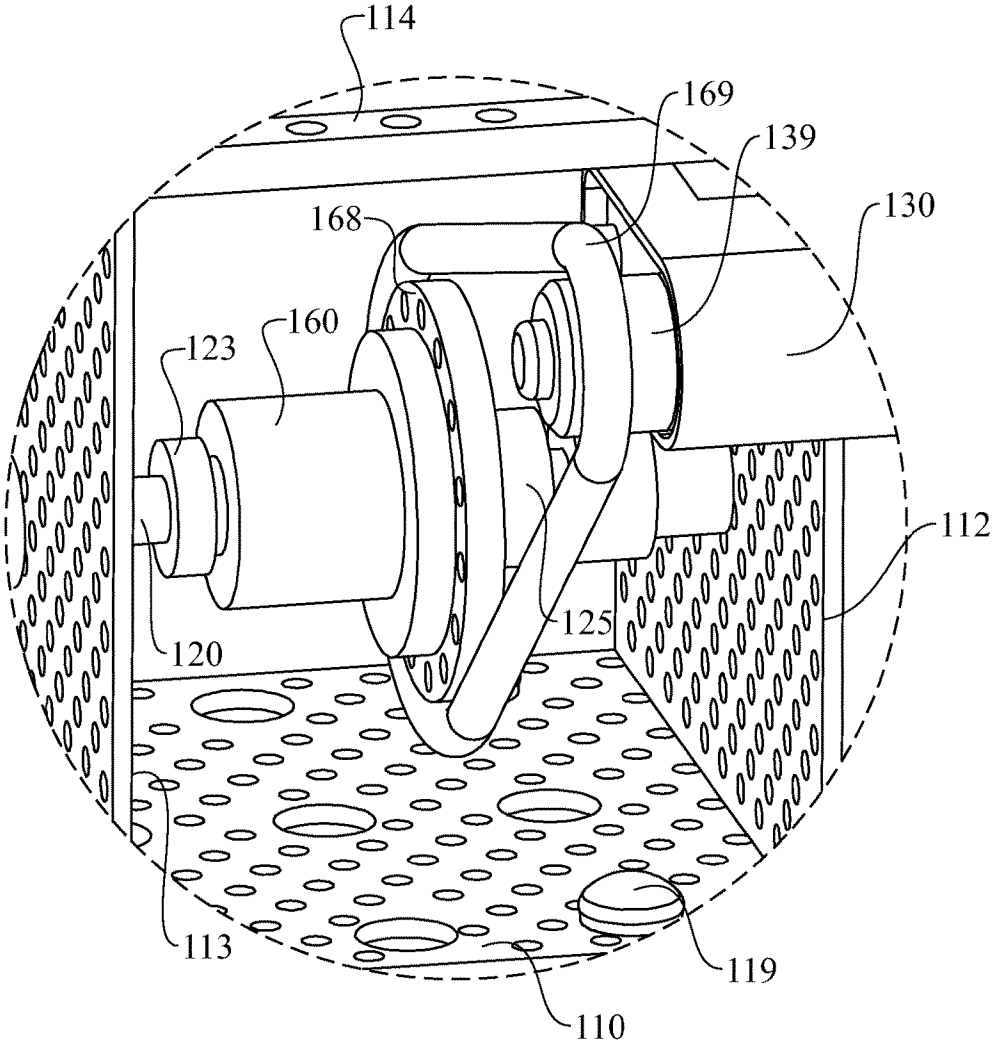
FIG. 6 presents an enlarged front, top elevation perspective view of the exemplary constant resistance exercise machine originally introduced in FIG. 1, the illustration detailing a pulley system between a flywheel and adjustable resistance generating system and a one-way clutch bearing.
Figure 8:
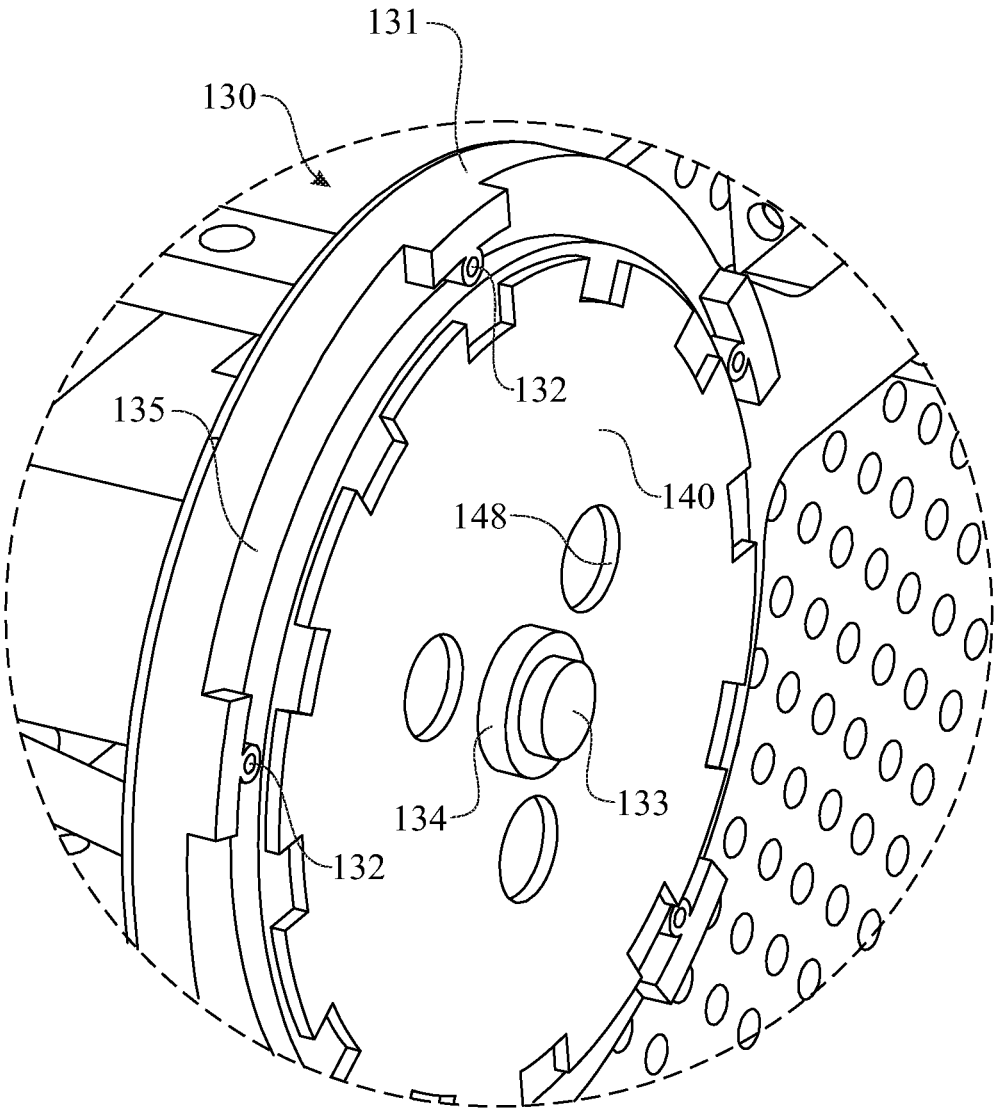
FIG. 8 presents an enlarged partial assembly view of the exemplary constant resistance exercise machine originally introduced in FIG. 1, the illustration detailing a portion of operating elements of the flywheel and adjustable resistance generating system.

The one-way clutch assembly 160 can be any suitable one-way clutch assembly. The one-way clutch assembly 160 can be directly or indirectly coupled to the adjustable magnetic resistance unit non-magnetic flywheel 140. The exemplary illustrations present an arrangement where the one-way clutch assembly 160 is indirectly coupled to the adjustable magnetic resistance unit non-magnetic flywheel 140. In the exemplary arrangement, the adjustable magnetic resistance unit non-magnetic flywheel 140 is assembled to an adjustable magnetic resistance unit axle 133 by an adjustable magnetic resistance unit axle nut 134, as shown in FIG. 8. An adjustable magnetic resistance unit drive pulley 139 is secured to an opposite end of the adjustable magnetic resistance unit axle 133, as shown in FIG. 6. A one-way clutch bearing pulley 168 is assembled to an input element of the one-way clutch assembly 160, as shown in FIG. 6. A clutch drive element 169 operationally couples the adjustable magnetic resistance unit drive pulley 139 and the one-way clutch bearing pulley 168 to one another. In this arrangement, the one-way clutch assembly 160 and the adjustable magnetic resistance unit non-magnetic flywheel 140 would be assembled in an offset or non-concentric arrangement. The adjustable magnetic resistance unit drive pulley 139 and the one-way clutch bearing pulley 168 are preferably arranged in a radial alignment with one another.

The one-way clutch assembly 160 is installed in an orientation to provide resistance to a rotational motion of the exercise cable storage and feed reel 190 when the exercise cable 192 is drawn from the exercise cable storage and feed reel 190 and to spin freely when the exercise cable 192 is being collected onto the drum of the exercise cable storage and feed reel 190. A constant resistance exercise machine operating central support panel shaft clamp 123 and a constant resistance exercise machine operating clutch assembly central shaft clamp 125 can be assembled to the constant resistance exercise machine operating shaft 120, wherein the constant resistance exercise machine operating central support panel shaft clamp 123 and the constant resistance exercise machine operating clutch assembly central shaft clamp 125 are located on opposite sides of the one-way clutch assembly 160. The constant resistance exercise machine operating central support panel shaft clamp 123 and constant resistance exercise machine operating clutch assembly central shaft clamp 125 are provided to retain the components in an axial position on the constant resistance exercise machine operating shaft 120 and or within the support structure of the constant resistance exercise machine 100.

In an alternative arrangement, the one-way clutch assembly 160 and the adjustable magnetic resistance unit non-magnetic flywheel 140 (or a shaft of the adjustable magnetic resistance unit non-magnetic flywheel 140) can be directly coupled to one another. In this arrangement, the one-way clutch assembly 160 and the adjustable magnetic resistance unit non-magnetic flywheel 140 would be assembled in a coaxial arrangement.

The adjustable magnetic resistance unit 130 provides rotational resistance to the adjustable magnetic resistance unit non-magnetic flywheel 140. Details of the adjustable magnetic resistance unit 130 and adjustable magnetic resistance unit non-magnetic flywheel 140 are presented in FIGS. 8 through 11. The adjustable magnetic resistance unit non-magnetic flywheel 140 is assembled to the adjustable magnetic resistance unit axle 133 by the adjustable magnetic resistance unit axle nut 134. The adjustable magnetic resistance unit non-magnetic flywheel 140 can be fabricated include a plurality of adjustable magnetic resistance unit non-magnetic flywheel apertures 148. The plurality of the adjustable magnetic resistance unit non-magnetic flywheel apertures 148 are arranged to maintain a rotational balance of the adjustable magnetic resistance unit non-magnetic flywheel 140. In the exemplary illustration, each of the plurality of the adjustable magnetic resistance unit non-magnetic flywheel apertures 148 are of a like size and shape and are equally spaced and equally radially located about the adjustable magnetic resistance unit non-magnetic flywheel 140 to maintain rotational balance of the adjustable magnetic resistance unit non-magnetic flywheel 140. The plurality of the adjustable magnetic resistance unit non-magnetic flywheel apertures 148 can be of different sizes and/or shapes and arranged at different radial locations from a center of rotation of the adjustable magnetic resistance unit non-magnetic flywheel 140 to provide a rotationally balanced arrangement.

The adjustable magnetic resistance unit non-magnetic flywheel 140 is located between an adjustable magnetic resistance unit first magnetic resistance element 135 and an adjustable magnetic resistance unit second magnetic resistance element 145. The adjustable magnetic resistance unit first magnetic resistance element 135 is supported by an adjustable magnetic resistance unit first resistance adjustment disc 136. An adjustable magnetic resistance unit resistance spacing adjustment disc cam engaging flange 137 is formed centrally through the adjustable magnetic resistance unit first resistance adjustment disc 136. The adjustable magnetic resistance unit resistance spacing adjustment disc cam engaging flange 137 can be of any suitable shape, with the preferred shape of the adjustable magnetic resistance unit resistance spacing adjustment disc cam engaging flange 137 being a circle concentrically located with a peripheral edge of the adjustable magnetic resistance unit first magnetic resistance element 135. The adjustable magnetic resistance unit first resistance adjustment disc 136 can be rigidly fixed to an adjustable magnetic resistance unit first housing section 131 by any suitable assembly technique, including use of mechanical fasteners, a mechanical coupling, adhesive, and the like.

Figure 9:
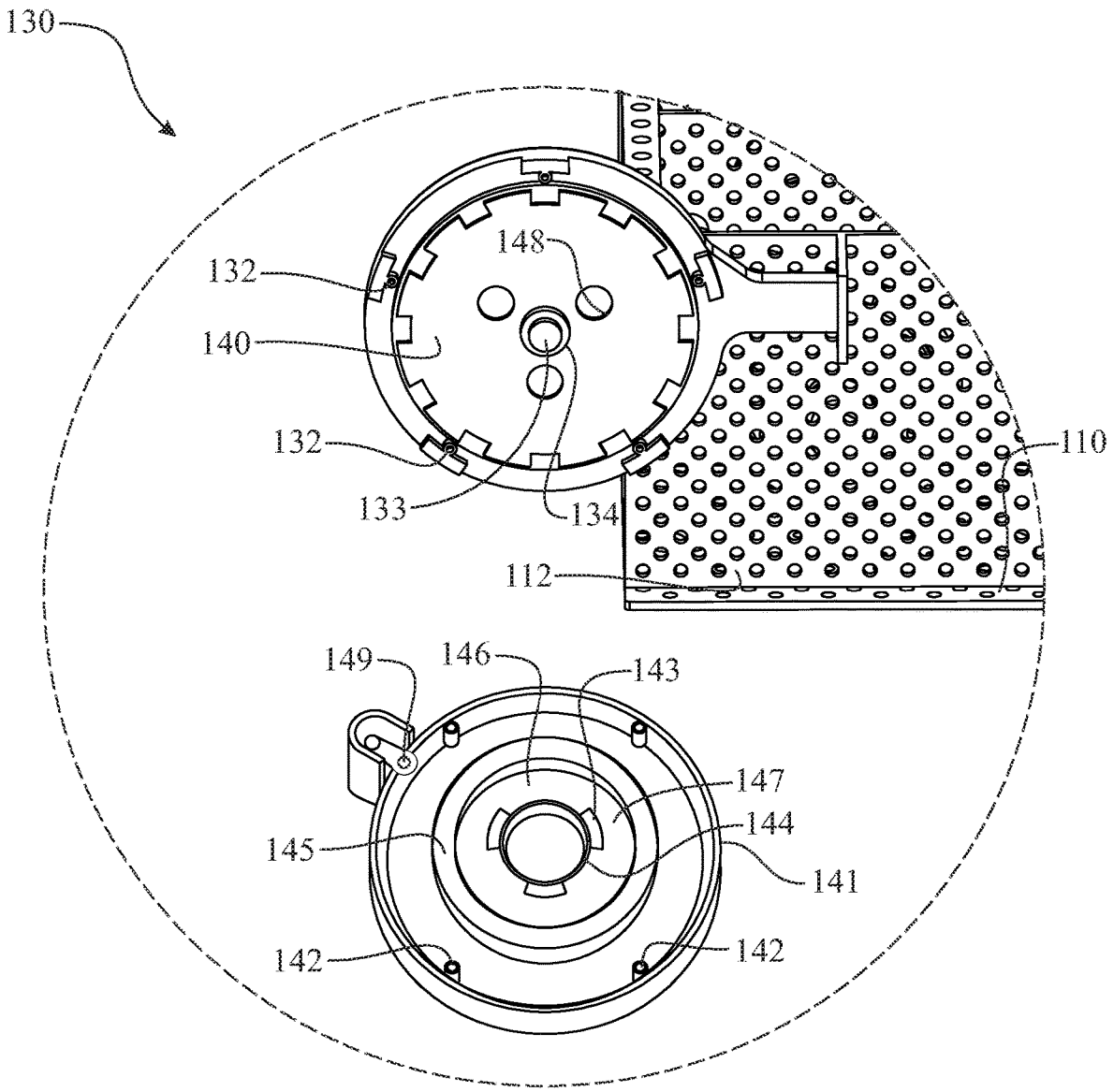
FIG. 9 presents an enlarged partial assembly view of the exemplary constant resistance exercise machine originally introduced in FIG. 1, the illustration detailing an opposite portion of the operating elements of the flywheel and adjustable resistance generating system.

Similarly, the adjustable magnetic resistance unit second magnetic resistance element 145 is supported by an adjustable magnetic resistance unit second resistance adjustment disc 146. An adjustable magnetic resistance unit resistance spacing adjustment disc cam engaging flange 147 is formed centrally through the adjustable magnetic resistance unit second resistance adjustment disc 146. The exemplary adjustable magnetic resistance unit resistance spacing adjustment disc cam engaging flange 147 includes a plurality of adjustable magnetic resistance unit resistance spacing adjustment disc cam clearances 147*a* for operational interaction with an adjustable magnetic resistance unit resistance spacing adjustment mechanism 143, as shown in FIG. 9. The adjustable magnetic resistance unit resistance spacing adjustment disc cam clearances 147*a* define respective notches. The notches provide a clearance for the adjustable magnetic resistance unit resistance spacing adjustment mechanism 143. An adjustable magnetic resistance unit resistance spacing adjustment mechanism cam surface 144 of the adjustable magnetic resistance unit resistance spacing adjustment mechanism 143 can be parallel to the adjustable magnetic resistance unit resistance spacing adjustment mechanism cam surface 144 or angled respective to the adjustable magnetic resistance unit resistance spacing adjustment mechanism cam surface 144. In an angled arrangement, the adjustable magnetic resistance unit resistance spacing adjustment mechanism 143 provides a wedge that increases pressure upon the adjustable magnetic resistance unit resistance spacing adjustment disc cam engaging flange 147 as the adjustable magnetic resistance unit resistance spacing adjustment mechanism 143 and adjustable magnetic resistance unit resistance spacing adjustment disc cam engaging flange 147 are rotated respective to one another.

The adjustable magnetic resistance unit non-magnetic flywheel 140 is fabricated having a peripheral edge 138. A plurality of alternating flywheel peripheral tabs 138*a* and respective notches 138*b* are arranged about the peripheral edge 138 of the adjustable magnetic resistance unit non-magnetic flywheel 140. An arched or radian dimension of each notch 138*b* and each respective tab 138*a* is preferably alike. The notches 138*b* have a designed depth inward from the adjustable magnetic resistance unit non-magnetic flywheel peripheral edge 138. The dimensions (radian dimension and depth) of the tabs 138*a* and notches 138*b* can be adjusted or tailored to modify resistance generated by the adjustable magnetic resistance unit first magnetic resistance element 135 and the adjustable magnetic resistance unit second magnetic resistance element 145.

The diameter of the adjustable magnetic resistance unit non-magnetic flywheel peripheral edge 138 can be greater than the diameter of the adjustable magnetic resistance unit first magnetic resistance element 135 and the adjustable magnetic resistance unit first resistance adjustment disc 136, substantially equal to the diameter of the adjustable magnetic resistance unit first magnetic resistance element 135 and the adjustable magnetic resistance unit first resistance adjustment disc 136, or less than the diameter of the adjustable magnetic resistance unit first magnetic resistance element 135 and the adjustable magnetic resistance unit first resistance adjustment disc 136.

The depth of the adjustable magnetic resistance unit non-magnetic flywheel peripheral notch 138*b* can be to a distance that aligns a lower edge of the adjustable magnetic resistance unit non-magnetic flywheel peripheral notch 138*b* at:

a. a depth to be proximate the diameter of the adjustable magnetic resistance unit first magnetic resistance element 135 and the adjustable magnetic resistance unit first resistance adjustment disc 136, b. a depth that is between an outer diameter of the adjustable magnetic resistance unit first magnetic resistance element 135 and the adjustable magnetic resistance unit second magnetic resistance element 145 and an inner diameter of the adjustable magnetic resistance unit first magnetic resistance element 135 and the adjustable magnetic resistance unit second magnetic resistance element 145, c. a depth that is between the outer diameter of the adjustable magnetic resistance unit first magnetic resistance element 135 and the adjustable magnetic resistance unit second magnetic resistance element 145 and a median dimension between the outer diameter of the adjustable magnetic resistance unit first magnetic resistance element 135 and the adjustable magnetic resistance unit second magnetic resistance element 145 and the inner diameter of the adjustable magnetic resistance unit first magnetic resistance element 135 and the adjustable magnetic resistance unit second magnetic resistance element 145, d. a depth that is proximate the median dimension between the outer diameter of the adjustable magnetic resistance unit first magnetic resistance element 135 and the adjustable magnetic resistance unit second magnetic resistance element 145 and the inner diameter of the adjustable magnetic resistance unit first magnetic resistance element 135 and the adjustable magnetic resistance unit second magnetic resistance element 145, or e. a depth that is between the adjustable magnetic resistance unit second magnetic resistance element 145 and the median dimension between the outer diameter of the adjustable magnetic resistance unit first magnetic resistance element 135 and the adjustable magnetic resistance unit second magnetic resistance element 145 and the inner diameter of the adjustable magnetic resistance unit first magnetic resistance element 135 and the adjustable magnetic resistance unit second magnetic resistance element 145 and the inner diameter of the adjustable magnetic resistance unit first magnetic resistance element 135.

The adjustable magnetic resistance unit first magnetic resistance element 135 and the adjustable magnetic resistance unit second magnetic resistance element 145 are arranged having magnetically polarized segments. Using the adjustable magnetic resistance unit second magnetic resistance element 145 as an example to describe the magnetic arrangement of the adjustable magnetic resistance unit second magnetic resistance element 145 and the adjustable magnetic resistance unit second magnetic resistance element 145.

The adjustable magnetic resistance unit second magnetic resistance element 145 is divided into 6 equally sized and shaped segments 240, 241, 242, 243, 244, 245, each being further identified by a suffix identifying a polarity of the segment. Each segment 240, 241, 242, 243, 244, 245 includes an axial magnetic orientation. Adjacently located segments are provided with opposite magnetic orientations. For example, the interior surface of the second magnetic disc polarity segment (0 degrees, interior side) 240 has a North polarity (identified as 240N) and the exterior surface of the second magnetic disc polarity segment (0 degrees, exterior side) 240 has a South polarity (identified as 240S). The segment located opposite (180 degrees) from the second magnetic disc polarity segment (0 degrees, interior side) 240 is identified as a second magnetic disc polarity segment (180 degrees, interior side) 241. The interior surface of the second magnetic disc polarity segment (180 degrees, interior side) 240 has a South polarity (identified as 241S) and the exterior surface of the second magnetic disc polarity segment (180 degrees, exterior side) 240 has a North polarity (identified as 240N). Essentially, each pair of segments (240, 241), (242, 243), and (244, 245) that are oriented 180 degrees from one another are arranged having opposite polarities.

Figure 10:
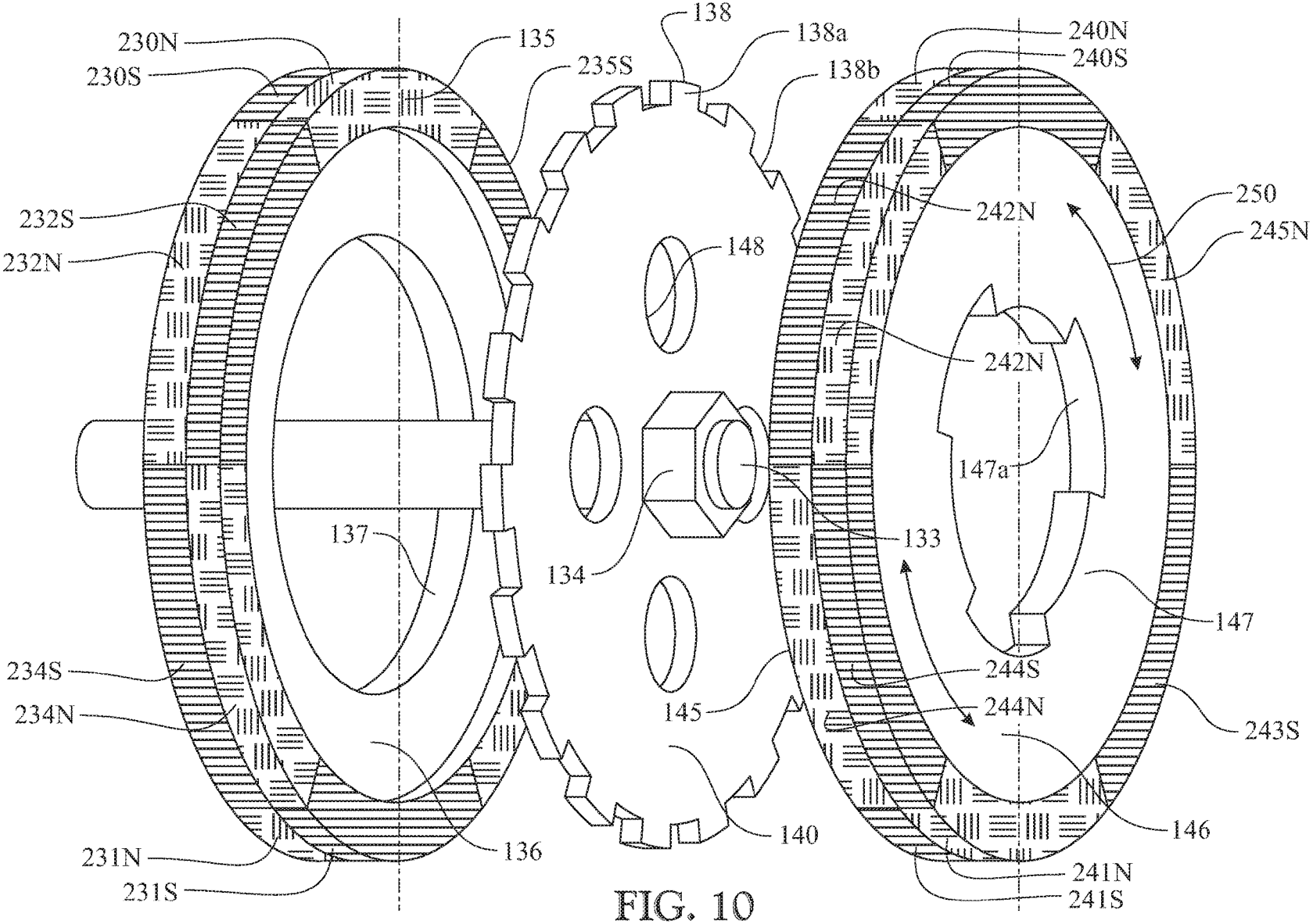
FIG. 10 presents an enlarged exploded assembly view of the exemplary constant resistance exercise machine originally introduced in FIG. 1, the illustration detailing resistance generating magnetically charged discs on each side of the flywheel, the illustration presenting an exemplary magnetic arrangement of each of the resistance generating magnetically charged discs, the resistance generating magnetically charged discs being oriented in a low resistance arrangement.
Figure 11:
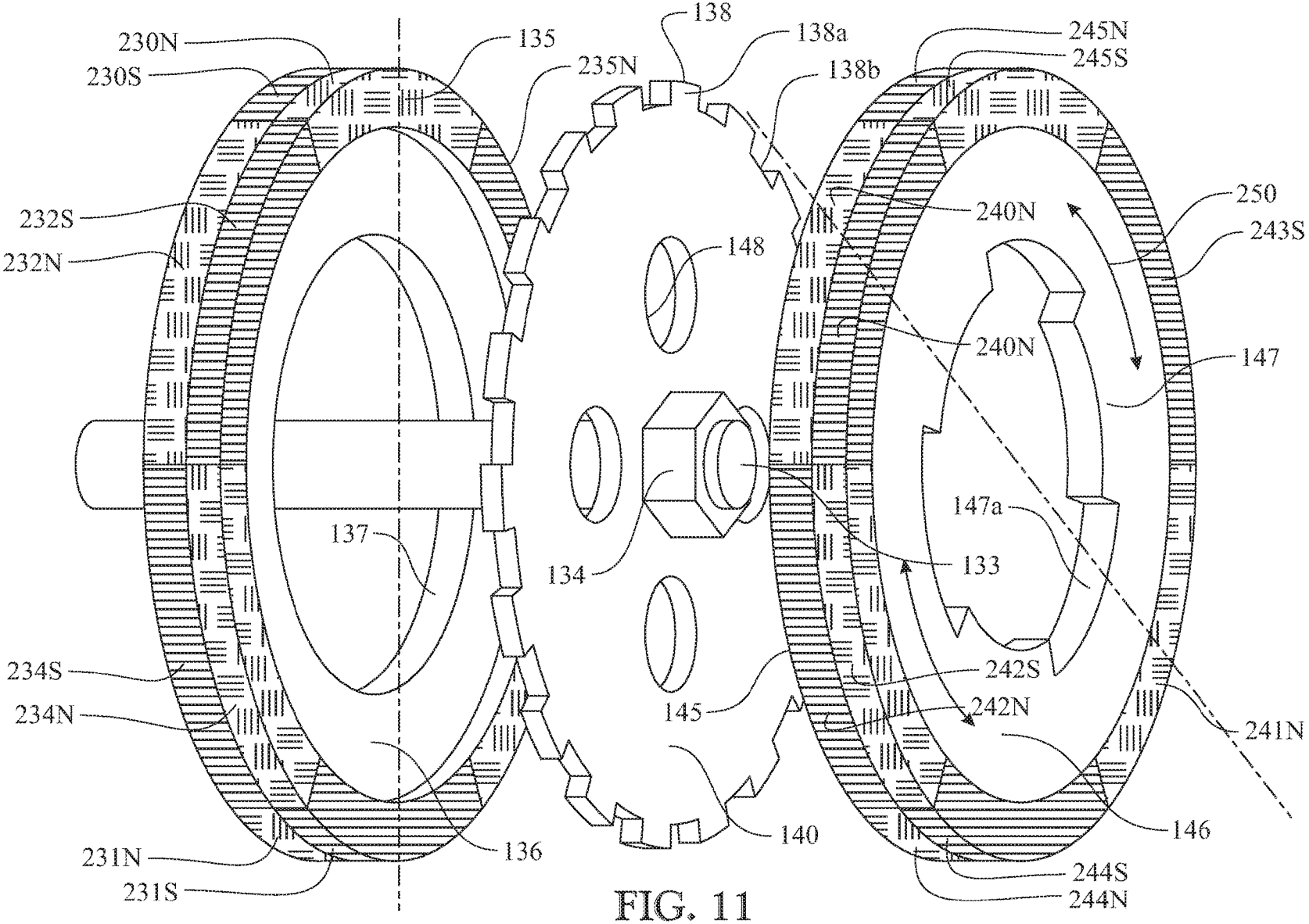
FIG. 11 presents an enlarged exploded assembly view of the exemplary constant resistance exercise machine originally introduced in FIG. 1, the illustration detailing resistance generating magnetically charged discs on each side of the flywheel, the illustration presenting an exemplary magnetic arrangement of each of the resistance generating magnetically charged discs, the resistance generating magnetically charged discs being oriented in a high resistance arrangement.

The adjustable magnetic resistance unit first magnetic resistance element 135 and the adjustable magnetic resistance unit second magnetic resistance element 145 are arranged to be opposing one another, with the adjustable magnetic resistance unit non-magnetic flywheel 140 being located between the adjustable magnetic resistance unit first magnetic resistance element 135 and the adjustable magnetic resistance unit second magnetic resistance element 145, and preferably equidistant from each of the adjustable magnetic resistance unit first magnetic resistance element 135 and the adjustable magnetic resistance unit second magnetic resistance element 145. The adjustable magnetic resistance unit 130 is designed enabling a rotation 250 of the adjustable magnetic resistance unit second resistance adjustment disc 146 respective to the orientation of the adjustable magnetic resistance unit first resistance adjustment disc 136, as best shown in FIGS. 10 and 11. Lenz's law states that the current induced in a circuit due to a change or a motion in a magnetic field is so directed as to oppose the change in flux and to exert a mechanical force opposing the motion.

The opposite magnetic rings 135, 145 create a Lenz effect between the two interior surfaces. The Lenz effect creates a resistance to the adjustable magnetic resistance unit non-magnetic flywheel 140. The inclusion of the plurality of tabs 138*a* and notches 138*b* aid in the effectiveness of the Lenz effect upon the adjustable magnetic resistance unit non-magnetic flywheel 140.

The resistance can be varied by rotating 250 the adjustable magnetic resistance unit second resistance adjustment disc 146 (which rotates the adjustable magnetic resistance unit second magnetic resistance element 145) respective to the adjustable magnetic resistance unit first resistance adjustment disc 136 (the adjustable magnetic resistance unit first magnetic resistance element 135). The resistance is lowest, in an orientation where like polarities (South-South or North-North) are facing one another, as illustrated in FIG. 10. The resistance is highest, in an orientation where opposite polarities (North-South or South-North) are facing one another, as illustrated in FIG. 11. The resistance increases when rotating 250 the adjustable magnetic resistance unit second resistance adjustment disc 146 from an orientation from FIG. 10 to FIG. 11 and decreases when rotating 250 the adjustable magnetic resistance unit second resistance adjustment disc 146 from an orientation from FIG. 11 to FIG. 10. The direction of rotation is inconsequential.

The inclusion of six (6) segments 230, 231, 232, 233, 234, 235 on the adjustable magnetic resistance unit first magnetic resistance element 135 and six (6) segments 240, 241, 242, 243, 244, 245 on the adjustable magnetic resistance unit second magnetic resistance element 145 are optimized to provide opposite polarities at 60 degree intervals, while providing a reasonable degree of rotation for adjusting the resistance. The resistance can be adjusted from lowest resistance to the highest resistance (or vice versa) with only a 60 degree rotation of the adjustable magnetic resistance unit second resistance adjustment disc 146. This also provides for a suitable variation in strength between the lowest resistance and the highest resistance.

In addition to the resistance provided by the Lenz effect, the level of resistance can be modified by adjusting a span or distance between the adjustable magnetic resistance unit first magnetic resistance element 135 and the adjustable magnetic resistance unit second magnetic resistance element 145. It would be preferable that the adjustable magnetic resistance unit non-magnetic flywheel 140 remains equidistant from and parallel with each of the adjustable magnetic resistance unit first magnetic resistance element 135 and the adjustable magnetic resistance unit second magnetic resistance element 145.

The adjustable magnetic resistance unit 130 can include an adjustable magnetic resistance unit first housing section 131 and an adjustable magnetic resistance unit second housing section 141. The adjustable magnetic resistance unit first housing section 131 and the adjustable magnetic resistance unit second housing section 141 are assembled to one another using any suitable assembly techniques. For example, the adjustable magnetic resistance unit first housing section 131 can include a series of adjustable magnetic resistance unit housing section assembly features 132. The adjustable magnetic resistance unit second housing section 141 can include a series of adjustable magnetic resistance unit housing section mating assembly features 142. Each adjustable magnetic resistance unit housing section assembly feature 132 and each respective adjustable magnetic resistance unit housing section mating assembly feature 142 are assembled to one another to join the adjustable magnetic resistance unit first housing section 131 and the adjustable magnetic resistance unit second housing section 141 to one another. The adjustable magnetic resistance unit housing section assembly features 132 and the adjustable magnetic resistance unit housing section mating assembly features 142 can be a series of pins and bores, where the pins would be inserted into the bores. The pins can be hollow, enabling insertion of a threaded fastener, such as a screw or bolt. It is understood that any suitable assembly configuration can be employed to assemble the adjustable magnetic resistance unit first housing section 131 and the adjustable magnetic resistance unit second housing section 141 to one another. The assembly method preferably enables disassembly of the adjustable magnetic resistance unit first housing section 131 and the adjustable magnetic resistance unit second housing section 141 for access to the internal components for servicing and repairs. Although the exemplary illustrations include a separate housing for the adjustable magnetic resistance unit 130, it is understood that the adjustable magnetic resistance unit does not have to be enclosed within a separate housing. The adjustable magnetic resistance unit can be enclosed in a housing shared with another component of the constant resistance exercise machine 100. It is also understood that the adjustable magnetic resistance unit does not have to be enclosed within a housing.

An adjustable magnetic resistance unit resistance adjustment unit adjustment mechanism 149 can be included, wherein the adjustable magnetic resistance unit resistance adjustment unit adjustment mechanism 149 provides an adjustment capability to the adjustable magnetic resistance unit second magnetic resistance element 145. The adjustable magnetic resistance unit resistance adjustment unit adjustment mechanism 149 enables rotation of the adjustable magnetic resistance unit second magnetic resistance element 145 within the housing 131, 141. The adjustable magnetic resistance unit resistance adjustment unit adjustment mechanism 149 is accessible from an outside of the housing 131, 141. The adjustable magnetic resistance unit resistance adjustment unit adjustment mechanism 149 includes a biased element that is either frictionally retained or engages with features, such as bosses, located along an arched segment of a peripheral edge of the adjustable magnetic resistance unit second housing section 141. The bosses can be equally spaced along the arched segment of the peripheral edge of the adjustable magnetic resistance unit second housing section 141, as best shown in FIG. 9. The user would use the adjustable magnetic resistance unit resistance adjustment unit adjustment mechanism 149 to rotate either the adjustable magnetic resistance unit resistance spacing adjustment mechanism 143 or the adjustable magnetic resistance unit second resistance adjustment disc 146 within the housing 131, 141. In the exemplary embodiment, the adjustable magnetic resistance unit resistance adjustment unit adjustment mechanism 149 is secured to the adjustable magnetic resistance unit second resistance adjustment disc 146, wherein movement of the adjustable magnetic resistance unit resistance adjustment unit adjustment mechanism 149 is translated into a rotational motion of the adjustable magnetic resistance unit second resistance adjustment disc 146. The rotational motion of the adjustable magnetic resistance unit second resistance adjustment disc 146 adjusts an angular relationship between the adjustable magnetic resistance unit second magnetic resistance element 145 and the adjustable magnetic resistance unit first magnetic resistance element 135.

The adjustable magnetic resistance unit 130 can be enhanced by introducing a friction applying assembly. For example, a spring biased element can adjustably apply a frictional force to the peripheral edge and/or the planar surface of the non-magnetic flywheel 140. The spring biased element can be completely removed or separated from the non-magnetic flywheel 140 to eliminate any contribution of the frictional force resistance. This can be mechanically adjusted, electrically adjusted, and the like.

Figure 15:
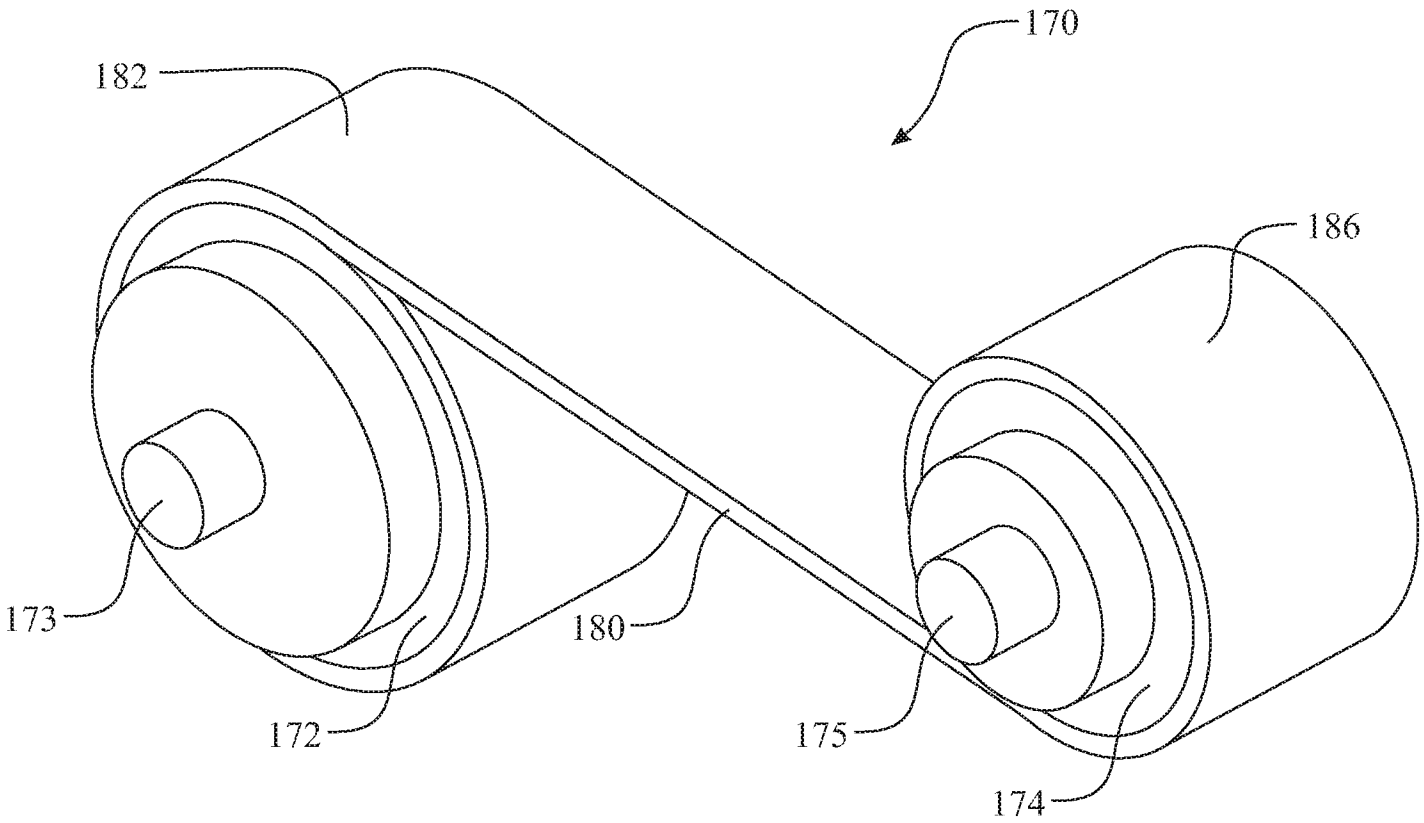
FIG. 15 presents an isometric schematic diagram of the constant tension spring motor.

A retracting mechanism retracts the exercise cable 192 when tension is removed from the exercise cable 192. The constant tension spring motor 170 provides a constant resistance when the exercise cable 192 is being withdrawn from the exercise cable storage and feed reel 190 and provides a function of a retracting mechanism when tension is removed from the exercise cable 192. Details of the constant tension spring motor 170 are presented in FIGS. 2, 3, 4, 7, 12, 13, 14, and 15. The constant tension spring motor 170 employs a constant tension spring motor output drum 172 and a constant tension spring motor storage drum 174. The constant tension spring motor output drum 172 rotates about a constant tension spring motor output drum axle 173. The constant tension spring motor storage drum 174 rotates about a constant tension spring motor storage drum axle 175. A constant tension spring motor spring 180 is fabricated of a spring material, such as spring steel, spring hardened copper, and the like. The constant tension spring motor spring 180 is fabricated as a linear sheet of planar spring material having at least one (preferably a pair) of constant tension spring motor supply spring attachment flange 183 at a constant tension spring motor collected spring portion 186 end of the constant tension spring motor spring 180. A constant tension spring motor supply spring attachment assistance aperture 184 can additionally be provided through at least one end (preferably at both ends) of the constant tension spring motor spring 180. A constant tension spring motor output or supply spring portion 182 refers to a portion of the constant tension spring motor spring 180 that is rolled upon a drum of the constant tension spring motor output drum 172 and retained upon the drum by a pair of flanges. A constant tension spring motor collected spring portion 186 refers to a portion of the constant tension spring motor spring 180 that is rolled upon a drum of the constant tension spring motor storage drum 174 and retained upon the drum by a pair of flanges. When referencing the constant tension spring motor 170 from one side, the constant tension spring motor output or supply spring portion 182 is rotated about the drum of the constant tension spring motor output drum 172 in a counterclockwise direction and the constant tension spring motor collected spring portion 186 is rotated about the drum of the constant tension spring motor storage drum 174 in a clockwise direction, as best shown in FIG. 15. It is understood that the orientation of the rotation would be respective to the desired direction of rotation for resistance and retraction, where the winding directions of the constant tension spring motor spring 180 can be as shown or reversed, based upon the application.

The end of the constant tension spring motor spring 180 defining the constant tension spring motor output or supply spring portion 182 can be retained in position and from unraveling on the constant tension spring motor output drum 172 by the spring tension alone. The end of the constant tension spring motor spring 180 defining the constant tension spring motor output or supply spring portion 182 can optionally be secured to the constant tension spring motor output drum 172 using any suitable attachment scheme. In one scheme, a mechanical attachment element (such as a screw, a clip, a pin, a hook, and the like) 185 is inserted through the constant tension spring motor supply spring attachment assistance aperture 184 located proximate an end of the constant tension spring motor output or supply spring portion 182 of the constant tension spring motor spring 180. The attachment scheme is not shown, as the illustrations present a configuration where the constant tension spring motor output or supply spring portion 182 is wound about the constant tension spring motor output drum 172.

Figure 12:
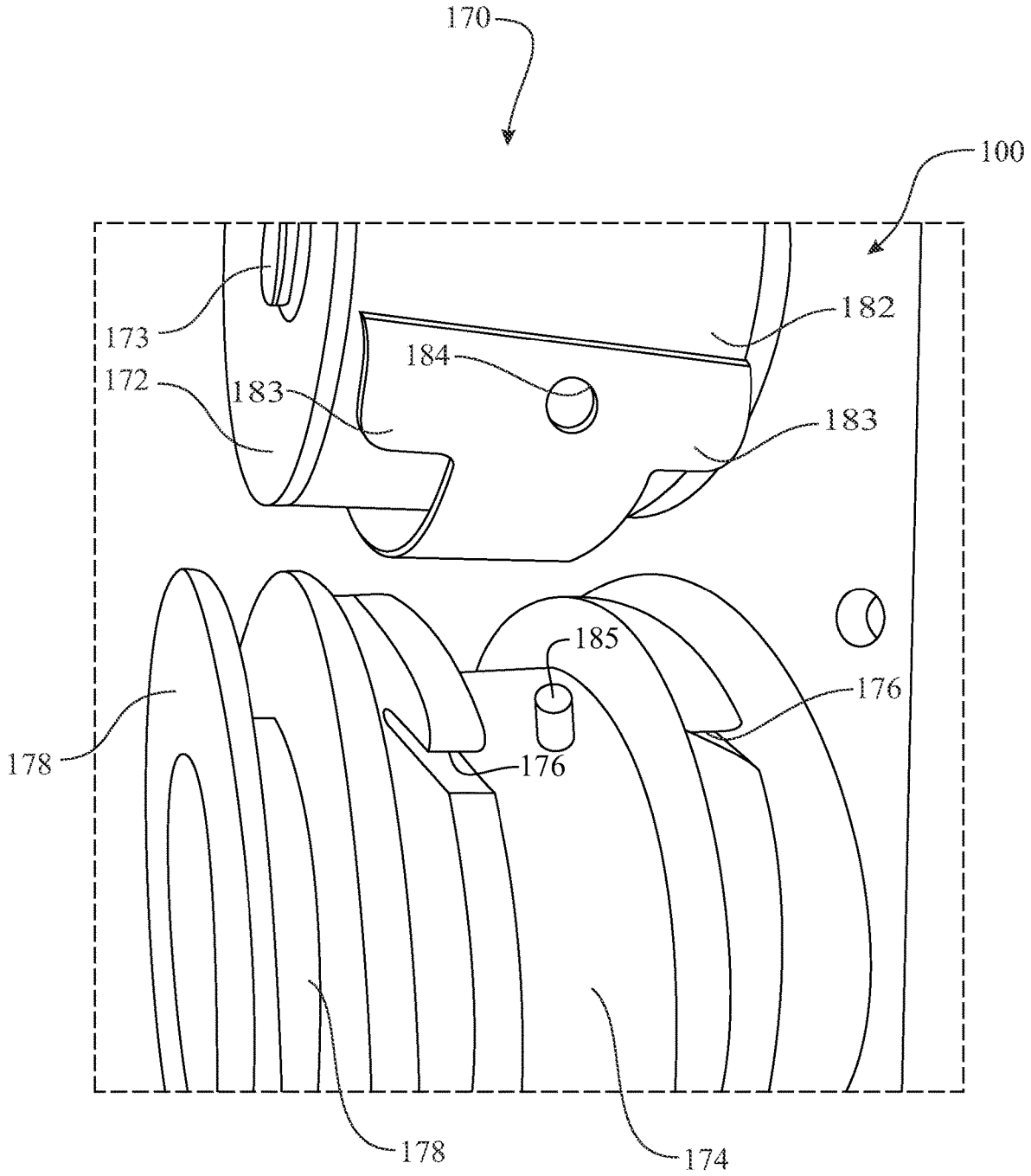
FIG. 12 presents an enlarged partial assembly view of the exemplary constant resistance exercise machine originally introduced in FIG. 1, the illustration detailing a constant tension spring motor.
Figure 13:
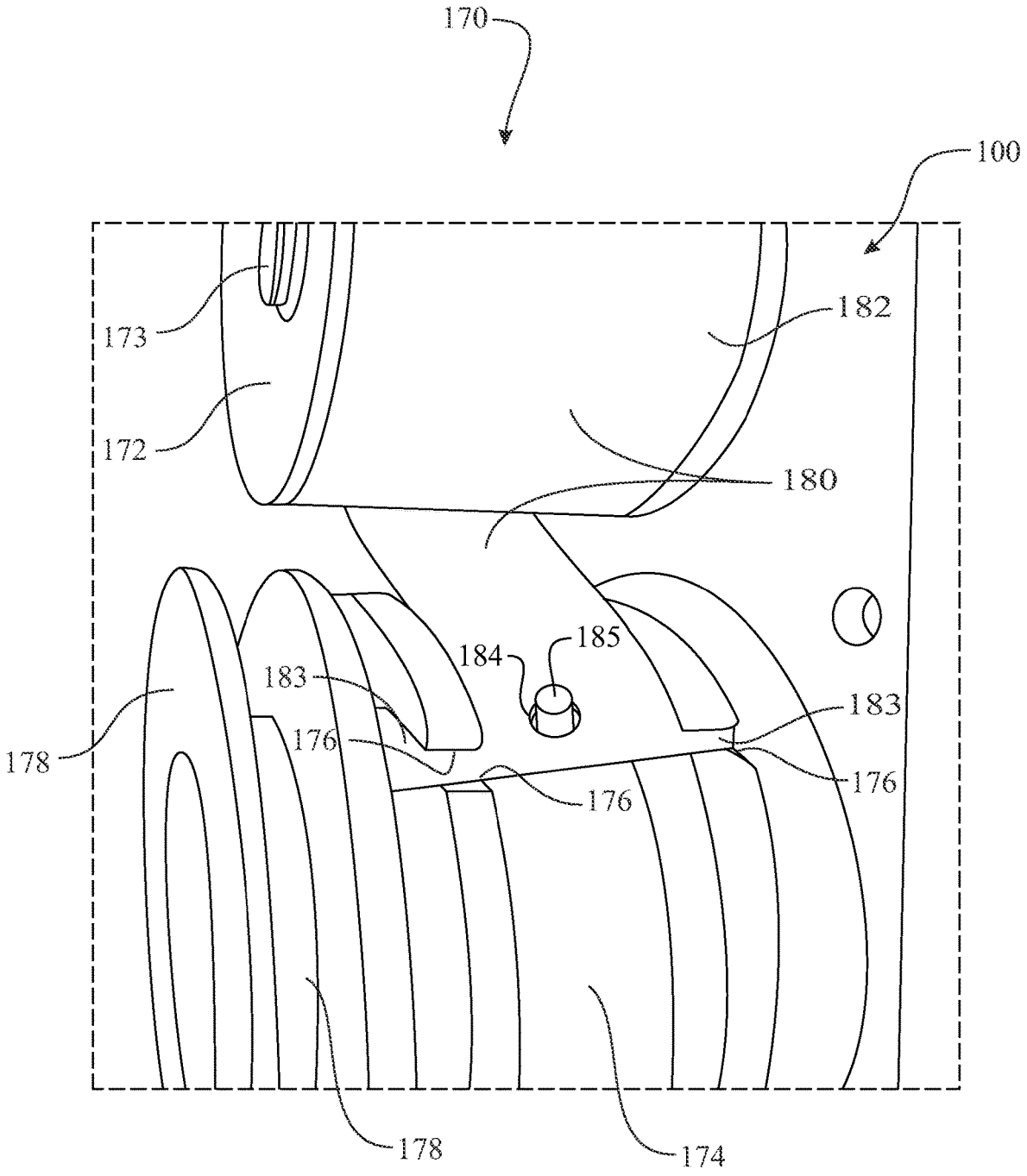
FIG. 13 presents an enlarged partial assembly view of the exemplary constant resistance exercise machine originally introduced in FIG. 1, the illustration detailing a constant tension spring motor prior to engagement of a free end of a constant tension spring motor spring to a constant tension spring motor storage drum.
Figure 14:
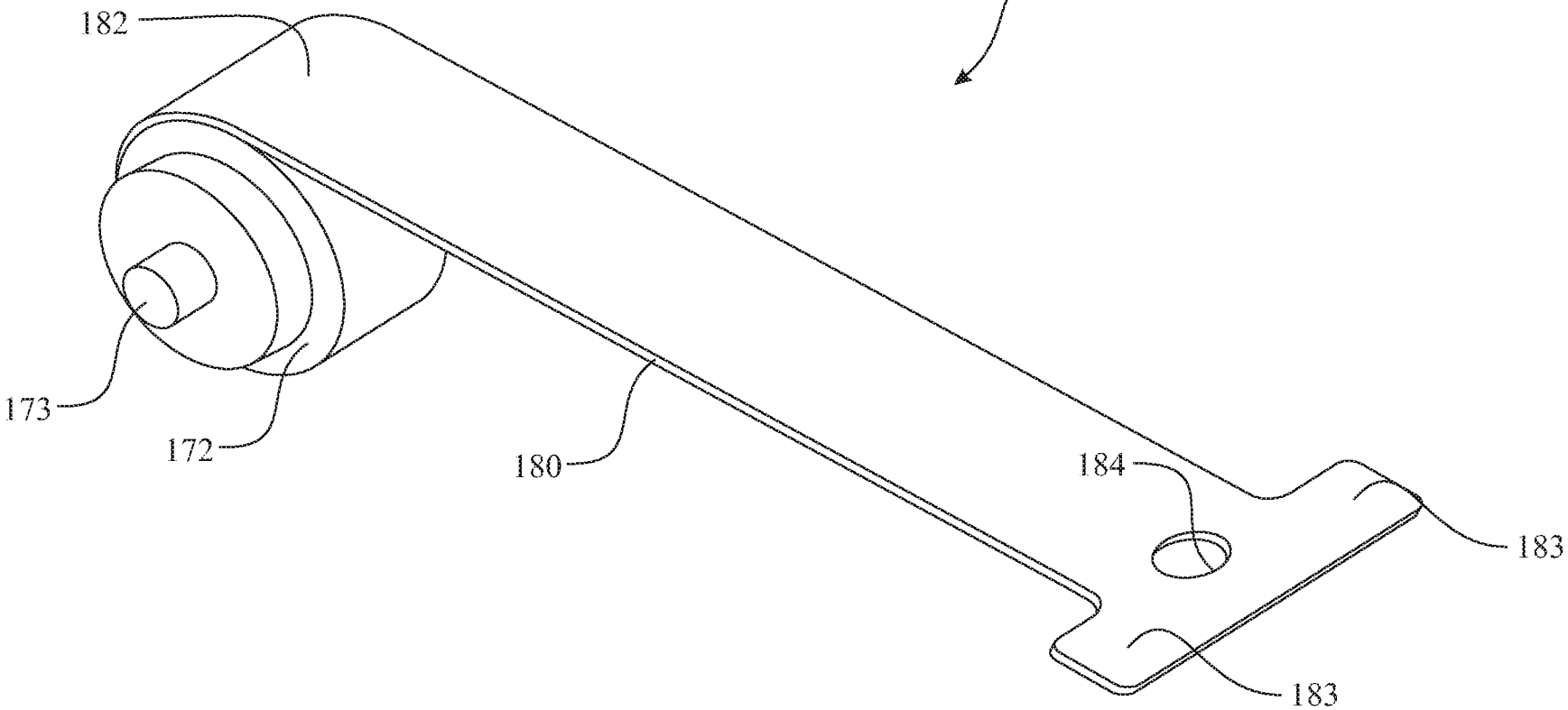
FIG. 14 presents an isometric schematic diagram of a portion of the constant tension spring motor.

The end of the constant tension spring motor spring 180 defining the constant tension spring motor collected spring portion 186 is secured to the constant tension spring motor storage drum 174 using any suitable attachment scheme. In the exemplary illustrated scheme, each of a pair of constant tension spring motor supply spring attachment flange 183 is inserted into a respective constant tension spring motor supply spring attachment slot 176 formed through an outer edge of a flange of the constant tension spring motor storage drum 174, as shown in FIGS. 12 and 13. It is understood that the end of the constant tension spring motor spring 180 defining the constant tension spring motor collected spring portion 186 can be secured to the constant tension spring motor storage drum 174 using any suitable attachment scheme. In another suitable attachment scheme, a mechanical attachment element (such as a screw, a clip, a pin, a hook, and the like) is inserted through the constant tension spring motor supply spring attachment assistance aperture 184 located proximate an end of the constant tension spring motor collected spring portion 186 of the constant tension spring motor spring 180.

Figure 7:
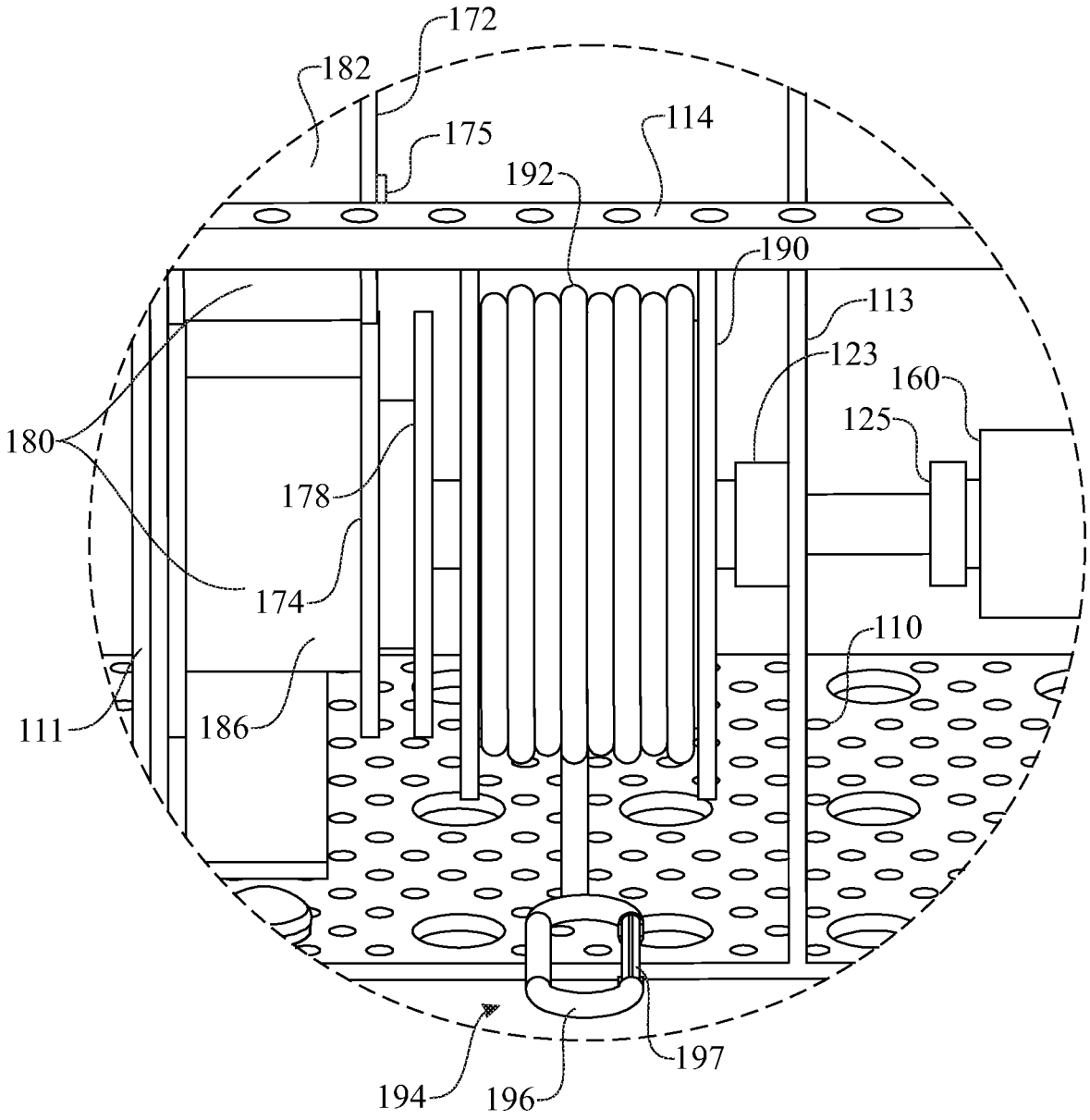
FIG. 7 presents an enlarged front, top elevation perspective view of the exemplary constant resistance exercise machine originally introduced in FIG. 1, the illustration detailing a constant tension spring motor and an exercise cable storage and feed reel.

The constant tension spring motor assembly flange 178 is secured to either the constant resistance exercise machine operating shaft 120 or a component of the exercise cable storage and feed reel 190, such as the flange, as best shown in FIG. 7. As the constant tension spring motor storage drum 174 is rotated in a direction extracting a length of exercise cable 192 from the exercise cable storage and feed reel 190, the constant tension spring motor spring 180 is transferred from the constant tension spring motor output drum 172 to the constant tension spring motor storage drum 174. The natural spring curve of the constant tension spring motor spring 180 introduces energy into the constant tension spring motor 170. The transfer and winding process creates a constant resistance, which is applied to the extraction of the exercise cable 192. This continues as long as a tension is applied to the exercise cable 192, removing a continued length of the exercise cable 192 from the exercise cable storage and feed reel 190. Once a tension applied to the exercise cable 192 is removed from the exercise cable 192, the constant tension spring motor spring 180 desires to return to a lowest stated of energy and rewinds from the constant tension spring motor storage drum 174 to the constant tension spring motor output drum 172. This rotates the constant tension spring motor storage drum 174 in an opposite direction, retracting the exercise cable 192 onto the exercise cable storage and feed reel 190.

The constant tension spring motor 170 can be of other configurations. For example, the constant tension spring motor 170 can include more than one constant tension spring motor spring 180. Two or more constant tension spring motor output drums 172 can feed a single constant tension spring motor storage drum 174. In a second configuration, the constant resistance exercise machine 100 can employ two or more constant tension spring motors 170.

In use, a length of the exercise cable 192 is spooled onto the exercise cable storage and feed reel 190. A free end of the exercise cable 192 is secured to a moving object, such as a sprinter, a component of an exercise machine, and the like. One exemplary application is presented in FIG. 5. The free end of the exercise cable 192 is secured to an exercising party harness 199 by the quick connect element, such as the carabiner 194. The exercising party harness 199 includes a loop for attachment of the quick connect element, such as the carabiner 194. Alternatively, the free end of the exercise cable 192 can be secured directly to the exercising party harness 199. It is understood that the exercising party harness 199 is exemplary of any moving object, including those on an exercise machine, such as a rowing machine, a stationary cycle, and the like.

As a length of exercise cable 192 is removed from the exercise cable storage and feed reel 190, the exercise cable storage and feed reel 190 rotates. As length of the exercise cable 192 is removed from the exercise cable storage and feed reel 190, the rotation of the exercise cable storage and feed reel 190 receives a resistance force from the adjustable magnetic resistance unit non-magnetic flywheel 140 and from the constant tension spring motor 170.

Details of the operation of the adjustable magnetic resistance unit non-magnetic flywheel 140 are provided as follows. The rotation of the exercise cable storage and feed reel 190 causes the one-way clutch assembly 160 to rotate. The one-way clutch assembly 160 only transfers a rotational motion to the adjustable magnetic resistance unit non-magnetic flywheel 140 when the one-way clutch assembly 160 is rotating in a direction where the exercise cable 192 is being extracted from the exercise cable storage and feed reel 190. When the exercise cable 192 is being collected onto the exercise cable storage and feed reel 190, the one-way clutch assembly 160 is designed to spin independently from the adjustable magnetic resistance unit non-magnetic flywheel 140. As the adjustable magnetic resistance unit non-magnetic flywheel 140 rotates, the adjustable magnetic resistance unit first magnetic resistance element 135 and the adjustable magnetic resistance unit second magnetic resistance element 145 provide a resistance based upon a Lenz effect. The level of rotational resistance applied to the adjustable magnetic resistance unit non-magnetic flywheel 140 can be adjusted by changing the rotated orientation of the magnetic segments 240, 241, 242, 243, 244, 245 of the adjustable magnetic resistance unit second magnetic resistance element 145 respective to the orientation of the magnetic segments 230, 231, 232, 233, 234, 235 of the adjustable magnetic resistance unit first magnetic resistance element 135. The resistance is lowest, in an orientation where like polarities (South-South or North-North) are facing one another, as illustrated in FIG. 10. The resistance is highest, in an orientation where opposite polarities (North-South or South-North) are facing one another, as illustrated in FIG. 11. The resistance increases when rotating 250 the adjustable magnetic resistance unit second resistance adjustment disc 146 from an orientation from FIG. 10 to FIG. 11 and decreases when rotating 250 the adjustable magnetic resistance unit second resistance adjustment disc 146 from an orientation from FIG. 11 to FIG. 10. The direction of rotation is inconsequential. Adjustments can be made by sliding the adjustable magnetic resistance unit resistance adjustment unit adjustment mechanism 149 along the peripheral edge of the housing 131, 141 causing the adjustable magnetic resistance unit second magnetic resistance element 145 to rotate in accordance with a second magnetic disc rotation 250. The user would position the adjustable magnetic resistance unit resistance adjustment unit adjustment mechanism 149 to obtain a desired resistance from the adjustable magnetic resistance unit non-magnetic flywheel 140. As the exercise cable 192 is drawn from the exercise cable storage and feed reel 190, the exercise cable storage and feed reel 190 causes the one-way clutch assembly 160 to rotate. The rotation of the one-way clutch assembly 160 during withdrawal of the exercise cable 192 from the exercise cable storage and feed reel 190 transfers a rotation to the adjustable magnetic resistance unit non-magnetic flywheel 140. As the adjustable magnetic resistance unit non-magnetic flywheel 140 rotates between the adjustable magnetic resistance unit first magnetic resistance element 135 and the adjustable magnetic resistance unit second magnetic resistance element 145, the Lenz effect generated by the magnetic segments 240, 241, 242, 243, 244, 245 of the adjustable magnetic resistance unit second magnetic resistance element 145 and the magnetic segments 230, 231, 232, 233, 234, 235 of the adjustable magnetic resistance unit first magnetic resistance element 135 provides a rotational resistance to the adjustable magnetic resistance unit non-magnetic flywheel 140. The rotational resistance of the adjustable magnetic resistance unit non-magnetic flywheel 140 applies a like rotational resistance to the one-way clutch assembly 160, which in turn transfers the rotational resistance to the exercise cable storage and feed reel 190. The one-way clutch assembly 160 and the exercise cable storage and feed reel 190 can be connected directly to one another or connected by way of the constant resistance exercise machine operating shaft 120.

Tension applied to the exercise cable 192 causes the exercise cable storage and feed reel 190 to rotate. The rotation of the exercise cable storage and feed reel 190 drives a rotation of the constant tension spring motor storage drum 174. As the constant tension spring motor storage drum 174 rotates, the constant tension spring motor storage drum 174 transfers the constant tension spring motor output or supply spring portion 182 portion of the constant tension spring motor spring 180 from the constant tension spring motor output drum 172 to the constant tension spring motor storage drum 174, wherein the collected portion of the constant tension spring motor spring 180 is identified as the constant tension spring motor collected spring portion 186 of the constant tension spring motor spring 180. The exercise cable storage and feed reel 190 can be coupled directly to the constant tension spring motor storage drum 174 by way of the constant tension spring motor assembly flange 178 or coupled indirectly by way of the constant resistance exercise machine operating shaft 120. As the constant tension spring motor spring 180 transfers material from the constant tension spring motor output drum 172 (spooled as the constant tension spring motor output or supply spring portion 182) to the constant tension spring motor storage drum 174 (spooled as the constant tension spring motor collected spring portion 186), energy is collected in the constant tension spring motor spring 180. The energy generates a resistance that is transferred to the rotational motion of the exercise cable storage and feed reel 190.

When the tension is removed from the exercise cable 192, the energy within the constant tension spring motor spring 180 causes the constant tension spring motor collected spring portion 186 to return from the constant tension spring motor storage drum 174 (spooled as the constant tension spring motor collected spring portion 186) to the constant tension spring motor output drum 172 (spooled as the constant tension spring motor output or supply spring portion 182). This causes the constant tension spring motor storage drum 174 to rotate in an opposite direction. The opposite rotation of the constant tension spring motor storage drum 174 rotates the exercise cable storage and feed reel 190 in a direction collecting the drawn length of the exercise cable 192. The rotation of the exercise cable storage and feed reel 190 also causes the one-way clutch assembly 160 to rotate. Since the one-way clutch assembly 160 only transfers the rotation to the adjustable magnetic resistance unit non-magnetic flywheel 140 in a single rotational direction, the rotation of the one-way clutch assembly 160 while the system collects the exercise cable 192 does not transfer any rotation to the adjustable magnetic resistance unit non-magnetic flywheel 140.

The advantage of the constant resistance exercise machine 100 over other types of devices is that the constant tension spring motor 170 provides a constant resistance over an extended length of the exercise cable 192. A gearing can be integrated between the constant tension spring motor storage drum 174 and the exercise cable storage and feed reel 190 to support an exercise cable 192 of even longer lengths. The exercise cable 192 can be up to 10 feet, up to 15 feet, up to 20 feet, up to 25 feet, up to 50 feet, up to 75 feet, up to 100 feet, or longer than 100 feet in length. The length of the exercise cable 192 would be determined by the application of the constant resistance exercise machine 100.

The constant resistance exercise machine 100 can be adapted for utilization for exercising animals (such as pets, livestock, pari-mutuel animals, and any other animal) as well as people.

Although the above provides a full and complete disclosure of the preferred embodiments of the invention, various modifications, combinations, alternate constructions and equivalents will occur to those skilled in the art. It is intended that all matters in the foregoing description and shown in the accompanying drawings be interpreted as illustrative and not in a limiting sense. Therefore the above should not be construed as limiting the invention, which is defined by the appended claims and their legal equivalence.

ELEMENT DESCRIPTION REFERENCES

Ref No. Description

100 constant resistance exercise machine
110 constant resistance exercise machine base member
111 constant resistance exercise machine first outer support panel
112 constant resistance exercise machine second outer support panel
113 constant resistance exercise machine central support panel
114 constant resistance exercise machine forward support beam
115 constant resistance exercise machine rear support beam
119 constant resistance exercise machine pliant foot
120 constant resistance exercise machine operating shaft
122 constant resistance exercise machine operating outer support panel shaft clamp
123 constant resistance exercise machine operating central support panel shaft clamp
125 constant resistance exercise machine operating clutch assembly central shaft clamp
127 constant resistance exercise machine operating clutch assembly exterior shaft clamp
130 adjustable magnetic resistance unit
131 adjustable magnetic resistance unit first housing section
132 adjustable magnetic resistance unit housing section assembly feature
133 adjustable magnetic resistance unit axle
134 adjustable magnetic resistance unit axle nut
135 adjustable magnetic resistance unit first magnetic resistance element
136 adjustable magnetic resistance unit first resistance adjustment disc
137 adjustable magnetic resistance unit resistance spacing adjustment disc cam engaging flange
138 adjustable magnetic resistance unit non-magnetic flywheel peripheral edge
**138*a*** adjustable magnetic resistance unit non-magnetic flywheel peripheral tab
**138*b*** adjustable magnetic resistance unit non-magnetic flywheel peripheral notch
139 adjustable magnetic resistance unit drive pulley
140 adjustable magnetic resistance unit non-magnetic flywheel
141 adjustable magnetic resistance unit second housing section
142 adjustable magnetic resistance unit housing section mating assembly feature
143 adjustable magnetic resistance unit resistance spacing adjustment mechanism
144 adjustable magnetic resistance unit resistance spacing adjustment mechanism cam surface
145 adjustable magnetic resistance unit second magnetic resistance element
146 adjustable magnetic resistance unit second resistance adjustment disc
147 adjustable magnetic resistance unit resistance spacing adjustment disc cam engaging flange
**147*a*** adjustable magnetic resistance unit resistance spacing adjustment disc cam clearance a
148 adjustable magnetic resistance unit non-magnetic flywheel aperture
149 adjustable magnetic resistance unit resistance adjustment unit adjustment mechanism
160 one-way clutch assembly
168 one-way clutch bearing pulley
169 clutch drive element (belt, gear, direct connection, etc)
170 constant tension spring motor
172 constant tension spring motor output drum
173 constant tension spring motor output drum axle
174 constant tension spring motor storage drum
175 constant tension spring motor storage drum axle
176 constant tension spring motor supply spring attachment slot
178 constant tension spring motor assembly flange
180 constant tension spring motor spring
182 constant tension spring motor output or supply spring portion
183 constant tension spring motor supply spring attachment flange
184 constant tension spring motor supply spring attachment assistance aperture
186 constant tension spring motor collected spring portion
190 exercise cable storage and feed reel
192 exercise cable
194 quick connect element (example being a carabiner)
196 carabiner spine and basket
197 carabiner gate
199 exercising party harness
230N first magnetic disc polarity segment (0 degrees, interior side, North polarity)
230S first magnetic disc polarity segment (0 degrees, exterior side, South polarity)
231N first magnetic disc polarity segment (180 degrees, exterior side, North polarity)
231S first magnetic disc polarity segment (180 degrees, interior side, South polarity)
232N first magnetic disc polarity segment (60 CC degrees, exterior side, North polarity)
232S first magnetic disc polarity segment (60 CC degrees, interior side, South polarity)
233N first magnetic disc polarity segment (120 CW degrees, interior side, North polarity)
234S first magnetic disc polarity segment (120 CC degrees, exterior side, South polarity)
235S first magnetic disc polarity segment (60 CW degrees, interior side, South polarity)
240N second magnetic disc polarity segment (0 degrees, interior side, North polarity)
240S second magnetic disc polarity segment (0 degrees, exterior side, South polarity)
241N second magnetic disc polarity segment (180 degrees, interior side, North polarity)
241S second magnetic disc polarity segment (180 degrees, exterior side, South polarity)
242N second magnetic disc polarity segment (60 CC degrees, interior side, North polarity)
242S second magnetic disc polarity segment (60 CC degrees, exterior side, South polarity)
243N second magnetic disc polarity segment (120 CW degrees, interior side, North polarity)
244N second magnetic disc polarity segment (120 CC degrees, exterior side, South polarity)
244S second magnetic disc polarity segment (120 CC degrees, interior side, North polarity)
245S second magnetic disc polarity segment (60 CW degrees, exterior side, South polarity)
250 second magnetic disc rotation
300 exercising party

What is claimed is:

1. A constant resistance exercise machine, comprising:

an exercise cable storage and feed reel;

a retraction mechanism in operational communication with the exercise cable storage and feed reel;

an exercise cable coiled about the exercise cable storage and feed reel;

a flywheel in unidirectional rotational communication with the exercise cable storage and feed reel by way of a one-way clutch bearing, and a resistance generating assembly providing rotational resistance to the flywheel, the resistance generating assembly comprising:

a first resistance generating magnetically charged disc located on a first side of the flywheel, the first resistance generating magnetically charged disc comprising a first arrangement of magnetic segments;

a second resistance generating magnetically charged disc located on a second, opposite side of the flywheel, the second resistance generating magnetically charged disc comprising a second arrangement of magnetic segments;

wherein the first resistance generating magnetically charged disc and the second resistance generating magnetically charged disc are rotatable respective to one another, wherein a rotation of the first resistance generating magnetically charged disc and the second resistance generating magnetically charged disc respective to one another changes the arrangement between:

(a) a configuration where like poles of the first arrangement of magnetic segments and the second arrangement of magnetic segments are facing one another and (b) a configuration where opposing poles of the first arrangement of magnetic segments and the second arrangement of magnetic segments are facing one another, wherein the exercise cable is of a length that enables complete extraction of the exercise cable from the exercise cable storage and feed reel, wherein the retraction mechanism is arranged to retract the exercise cable from an extracted condition back onto the exercise cable storage and feed reel.

2. The constant resistance exercise machine as recited in claim 1, wherein the retraction mechanism is a constant tension spring motor comprising:

a constant tension spring motor output drum integrated into the constant resistance exercise machine enabling rotation about a output drum central axis;

a constant tension spring motor storage drum integrated into the constant resistance exercise machine enabling rotation about a storage drum central axis;

a constant tension spring motor spring having a first spring end and a second spring end, wherein the first spring end is attached to the constant tension spring motor output drum and the second spring end is attached to the constant tension spring motor storage drum, wherein a first portion of the constant tension spring motor spring is wound about the constant tension spring motor output drum in a first wound direction and a second portion of the constant tension spring motor spring is wound about the constant tension spring motor storage drum in a second wound direction, wherein the first wound direction and the second wound direction are opposite one another.

3. The constant resistance exercise machine as recited in claim 2, wherein one of the first spring end or the second spring end is attached to the respective one of the constant tension spring motor output drum or the constant tension spring motor storage drum via at least one of:

(a) an aperture and a mechanical attachment element passing through the aperture, and (b) an attachment flange seated within a receiving attachment slot.

4. The constant resistance exercise machine as recited in claim 1, wherein the retraction mechanism is a constant tension spring motor.

5. The constant resistance exercise machine as recited in claim 1, the first arrangement of magnetic segments further comprising at least one pair of magnetic segments, wherein a first magnetic segment of each pair of the at least one pair of magnetic segments and a second magnetic segment of each pair of the at least one pair of magnetic segments are arranged having polarities oriented in opposite directions from one another; and the second arrangement of magnetic segments further comprising at least one pair of magnetic segments, wherein a first magnetic segment of each pair of the at least one pair of magnetic segments and a second magnetic segment of each pair of the at least one pair of magnetic segments are arranged having polarities oriented in opposite directions from one another.

6. The constant resistance exercise machine as recited in claim 1, the first arrangement of magnetic segments further comprising at least three pairs of magnetic segments, wherein a first magnetic segment of each pair of the at least three pairs of magnetic segments and a second magnetic segment of each pair of the at least three pairs of magnetic segments are arranged having polarities oriented in opposite directions from one another; and the second arrangement of magnetic segments further comprising at least three pairs of magnetic segments, wherein a first magnetic segment of each pair of the at least three pairs of magnetic segments and a second magnetic segment of each pair of the at least three pairs of magnetic segments are arranged having polarities oriented in opposite directions from one another.

7. The constant resistance exercise machine as recited in claim 1, further comprising a quick connect element assembled to a free end of the exercise cable, wherein the quick connect element is configured for securing the free end of the exercise cable to an exercising party.

8. A constant resistance exercise machine, comprising:

an exercise cable storage and feed reel;

a constant tension spring motor in operational communication with the exercise cable storage and feed reel;

a resistance generating assembly;

a flywheel obtaining rotational resistance from the resistance generating assembly, the flywheel in unidirectional rotational communication with the exercise cable storage and feed reel by way of a one-way clutch bearing; and an exercise cable coiled about the exercise cable storage and feed reel, wherein the exercise cable is of a length that enables complete extraction of the exercise cable from the exercise cable storage and feed reel, wherein the constant tension spring motor is arranged to retract the exercise cable from an extracted condition back onto the exercise cable storage and feed reel.

9. The constant resistance exercise machine as recited in claim 8, the resistance generating assembly further comprising:

a first resistance generating magnetically charged disc located on a first side of the flywheel, the first resistance generating magnetically charged disc comprising a first arrangement of magnetic segments;

a second resistance generating magnetically charged disc located on a second, opposite side of the flywheel, the second resistance generating magnetically charged disc comprising a second arrangement of magnetic segments;

wherein the first resistance generating magnetically charged disc and the second resistance generating magnetically charged disc are rotatable respective to one another, wherein a rotation of the first resistance generating magnetically charged disc and the second resistance generating magnetically charged disc respective to one another changes the arrangement between:

(a) a configuration where like poles of the first arrangement of magnetic segments and the second arrangement of magnetic segments are facing one another and (b) a configuration where opposing poles of the first arrangement of magnetic segments and the second arrangement of magnetic segments are facing one another.

10. The constant resistance exercise machine as recited in claim 9, the first arrangement of magnetic segments further comprising at least one pair of magnetic segments, wherein a first magnetic segment of each pair of the at least one pair of magnetic segments and a second magnetic segment of each pair of the at least one pair of magnetic segments are arranged having polarities oriented in opposite directions from one another; and the second arrangement of magnetic segments further comprising at least one pair of magnetic segments, wherein a first magnetic segment of each pair of the at least one pair of magnetic segments and a second magnetic segment of each pair of the at least one pair of magnetic segments are arranged having polarities oriented in opposite directions from one another.

11. The constant resistance exercise machine as recited in claim 9, the first arrangement of magnetic segments further comprising at least three pairs of magnetic segments, wherein a first magnetic segment of each pair of the at least three pairs of magnetic segments and a second magnetic segment of each pair of the at least three pairs of magnetic segments are arranged having polarities oriented in opposite directions from one another; and the second arrangement of magnetic segments further comprising at least three pairs of magnetic segments, wherein a first magnetic segment of each pair of the at least three pairs of magnetic segments and a second magnetic segment of each pair of the at least three pairs of magnetic segments are arranged having polarities oriented in opposite directions from one another.

12. The constant resistance exercise machine as recited in claim 8, wherein the constant tension spring motor comprises:

a constant tension spring motor output drum integrated into the constant resistance exercise machine enabling rotation about a output drum central axis;

a constant tension spring motor storage drum integrated into the constant resistance exercise machine enabling rotation about a storage drum central axis;

a constant tension spring motor spring having a first spring end and a second spring end, wherein the first spring end is attached to the constant tension spring motor output drum and the second spring end is attached to the constant tension spring motor storage drum, wherein a first portion of the constant tension spring motor spring is wound about the constant tension spring motor output drum in a first wound direction and a second portion of the constant tension spring motor spring is wound about the constant tension spring motor storage drum in a second wound direction, wherein the first wound direction and the second wound direction are opposite one another.

13. The constant resistance exercise machine as recited in claim 12, wherein one of the first spring end or the second spring end is attached to the respective one of the constant tension spring motor output drum or the constant tension spring motor storage drum via at least one of:

(a) an aperture and a mechanical attachment element passing through the aperture, and (b) an attachment flange seated within a receiving attachment slot.

14. A constant resistance exercise machine, comprising:

an exercise cable storage and feed reel;

a retraction mechanism in operational communication with the exercise cable storage and feed reel;

an exercise cable coiled about the exercise cable storage and feed reel, a resistance generating assembly; and a flywheel obtaining rotational resistance from the resistance generating assembly, the flywheel in unidirectional rotational communication with the exercise cable storage and feed reel by way of a one-way clutch bearing, wherein the exercise cable is of a length that enables complete extraction of the exercise cable from the exercise cable storage and feed reel, wherein the retraction mechanism spring motor is arranged to retract the exercise cable from an extracted condition back onto the exercise cable storage and feed reel.

15. The constant resistance exercise machine as recited in claim 14, the resistance generating assembly further comprising:

a first resistance generating magnetically charged disc located on a first side of the flywheel, the first resistance generating magnetically charged disc comprising a first arrangement of magnetic segments;

a second resistance generating magnetically charged disc located on a second, opposite side of the flywheel, the second resistance generating magnetically charged disc comprising a second arrangement of magnetic segments;

wherein the first resistance generating magnetically charged disc and the second resistance generating magnetically charged disc are rotatable respective to one another, wherein a rotation of the first resistance generating magnetically charged disc and the second resistance generating magnetically charged disc respective to one another changes the arrangement between:

(a) a configuration where like poles of the first arrangement of magnetic segments and the second arrangement of magnetic segments are facing one another and (b) a configuration where opposing poles of the first arrangement of magnetic segments and the second arrangement of magnetic segments are facing one another.

16. The constant resistance exercise machine as recited in claim 15, the first arrangement of magnetic segments further comprising at least one pair of magnetic segments, wherein a first magnetic segment of each pair of the at least one pair of magnetic segments and a second magnetic segment of each pair of the at least one pair of magnetic segments are arranged having polarities oriented in opposite directions from one another; and the second arrangement of magnetic segments further comprising at least one pair of magnetic segments, wherein a first magnetic segment of each pair of the at least one pair of magnetic segments and a second magnetic segment of each pair of the at least one pair of magnetic segments are arranged having polarities oriented in opposite directions from one another.

17. The constant resistance exercise machine as recited in claim 15, the first arrangement of magnetic segments further comprising at least three pairs of magnetic segments, wherein a first magnetic segment of each pair of the at least three pairs of magnetic segments and a second magnetic segment of each pair of the at least three pairs of magnetic segments are arranged having polarities oriented in opposite directions from one another; and the second arrangement of magnetic segments further comprising at least one pair of magnetic segments, wherein a first magnetic segment of each pair of the at least three pairs of magnetic segments and a second magnetic segment of each pair of the at least three pairs of magnetic segments are arranged having polarities oriented in opposite directions from one another.

18. The constant resistance exercise machine as recited in claim 14, wherein the retraction mechanism is a constant tension spring motor comprising:

a constant tension spring motor output drum integrated into the constant resistance exercise machine enabling rotation about a output drum central axis, a constant tension spring motor storage drum integrated into the constant resistance exercise machine enabling rotation about a storage drum central axis, and a constant tension spring motor spring having a first spring end and a second spring end, wherein the first spring end is attached to the constant tension spring motor output drum and the second spring end is attached to the constant tension spring motor storage drum, wherein a first portion of the constant tension spring motor spring is wound about the constant tension spring motor output drum in a first wound direction and a second portion of the constant tension spring motor spring is wound about the constant tension spring motor storage drum in a second wound direction, wherein the first wound direction and the second wound direction are opposite one another;

an exercise cable coiled about the exercise cable storage and feed reel.

19. The constant resistance exercise machine as recited in claim 18, wherein one of the first spring end or the second spring end is attached to the respective one of the constant tension spring motor output drum or the constant tension spring motor storage drum via at least one of:

(a) an aperture and a mechanical attachment element passing through the aperture, and (b) an attachment flange seated within a receiving attachment slot.

20. The constant resistance exercise machine as recited in claim 14, further comprising a quick connect element assembled to a free end of the exercise cable, wherein the quick connect element is configured for securing the free end of the exercise cable to an exercising party.

* * * * *